US011814947B2

(12) United States Patent
Stark et al.

(10) Patent No.: US 11,814,947 B2
(45) Date of Patent: Nov. 14, 2023

(54) DISTRIBUTED DIAGNOSTICS AND CONTROL OF A MULTI-UNIT PUMPING OPERATION

(71) Applicant: HALLIBURTON ENERGY SERVICES, INC., Houston, TX (US)

(72) Inventors: Daniel Joshua Stark, Carrollton, TX (US); Sergei Parsegov, Houston, TX (US); Tirumani Swaminathan, Houston, TX (US); Baidurja Ray, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 128 days.

(21) Appl. No.: 17/365,729

(22) Filed: Jul. 1, 2021

(65) Prior Publication Data

US 2023/0003115 A1 Jan. 5, 2023

(51) Int. Cl.

| | |
|---|---|
| ***E21B 47/008*** | (2012.01) |
| ***F04B 47/00*** | (2006.01) |
| ***E21B 43/12*** | (2006.01) |
| ***F04B 49/06*** | (2006.01) |
| ***E21B 43/26*** | (2006.01) |

(52) U.S. Cl.

CPC ..... *E21B 47/008* (2020.05); *E21B 43/121* (2013.01); *F04B 47/00* (2013.01); *F04B 49/065* (2013.01); *E21B 43/26* (2013.01); *F04B 2207/70* (2013.01)

(58) Field of Classification Search

CPC .. E21B 43/2607; E21B 2200/20; E21B 41/00; E21B 43/26; E21B 2200/22; E21B 43/267; E21B 44/00; E21B 47/00

See application file for complete search history.

(56) References Cited

U.S. PATENT DOCUMENTS

| | | | |
|---|---|---|---|
| 4,355,310 | A | 10/1982 | Belaigues et al. |
| 4,636,934 | A | 1/1987 | Schwendemann et al. |
| 5,734,373 | A | 3/1998 | Rosenberg et al. |
| 7,583,618 | B2 | 9/2009 | Reinders |

(Continued)

FOREIGN PATENT DOCUMENTS

| | | | |
|---|---|---|---|
| WO | 2016094192 A1 | 6/2016 | |
| WO | WO-2016168622 A1 * | 10/2016 | ..... E21B 7/04 |

(Continued)

OTHER PUBLICATIONS

Examination Report; CA Application No. 3,125,460; dated Jan. 27, 2023.

*Primary Examiner* — Zakiya W Bates

(74) *Attorney, Agent, or Firm* — NOVAK DRUCE CARROLL LLP

(57) ABSTRACT

Aspects of the subject technology relate to systems and methods for optimizing multi-unit pumping operations at a well site. Systems and methods are provided for receiving sensor data from a hydraulic fracturing fleet equipment at an equipment system, designating an event as being flagged based on the sensor data from the hydraulic fracturing fleet equipment, determining a physical action based on the flagged event and a priority list of actions, and providing instructions to a first pump of the hydraulic fracturing fleet equipment to perform the physical action based on the flagged event and the priority list of actions.

20 Claims, 10 Drawing Sheets

(56) References Cited

U.S. PATENT DOCUMENTS

| | | | | |
|---|---|---|---|---|
| 8,649,909 | B1 | 2/2014 | Phillips | |
| 2004/0100394 | A1 | 5/2004 | Hitt | |
| 2008/0164021 | A1* | 7/2008 | Dykstra | E21B 43/267 166/250.1 |
| 2019/0107466 | A1* | 4/2019 | Oehring | E21B 43/2607 |
| 2020/0256177 | A1 | 8/2020 | Mazrooee et al. | |

FOREIGN PATENT DOCUMENTS

| | | | |
|---|---|---|---|
| WO | 2020097053 | A1 | 5/2020 |
| WO | 2020131086 | A1 | 6/2020 |
| WO | 2020145979 | A1 | 7/2020 |
| WO | 2020153960 | A1 | 7/2020 |

* cited by examiner

DISTRIBUTED DIAGNOSTICS AND CONTROL OF A MULTI-UNIT PUMPING OPERATION

TECHNICAL FIELD

The present technology pertains to optimizing hydraulic fracturing processes and, more particularly, to optimizing multi-unit pumping operations.

BACKGROUND

During hydraulic fracturing operations, a multi-unit pumping system, such as a fracturing spread including multiple pumps and blenders, may experience many events that can lead to safety concerns, damage to the equipment, performance failure of a job, and cost-inefficient processes to complete the job. These concerning events can stem from several different types of systems including: engine issues, leaking pump valves, unstable engine revolutions, and transmission issues. Furthermore, multiple concerning events can occur at the same time within a particular system. Moreover, all of these events can last for long durations of time, overlap temporally with each other, and have different levels of severity or contradicting methods of mitigation. Also, business priorities may not be known or easily found by an operator or crew such as those related to costs, history with a customer, and historical use of units. The business priorities may also differ between the crew, the customer, and management, which may also change based on real-time market conditions or job location. This myriad of issues distracts the operator and crew and can lead to costly, improper decisions being made during real-time operations.

BRIEF DESCRIPTION OF THE DRAWINGS

In order to describe the manner in which the features and advantages of this disclosure can be obtained, a more particular description is provided with reference to specific embodiments thereof which are illustrated in the appended drawings. Understanding that these drawings depict only exemplary embodiments of the disclosure and are not therefore to be considered to be limiting of its scope, the principles herein are described and explained with additional specificity and detail through the use of the accompanying drawings in which.

DETAILED DESCRIPTION

Figure 1:
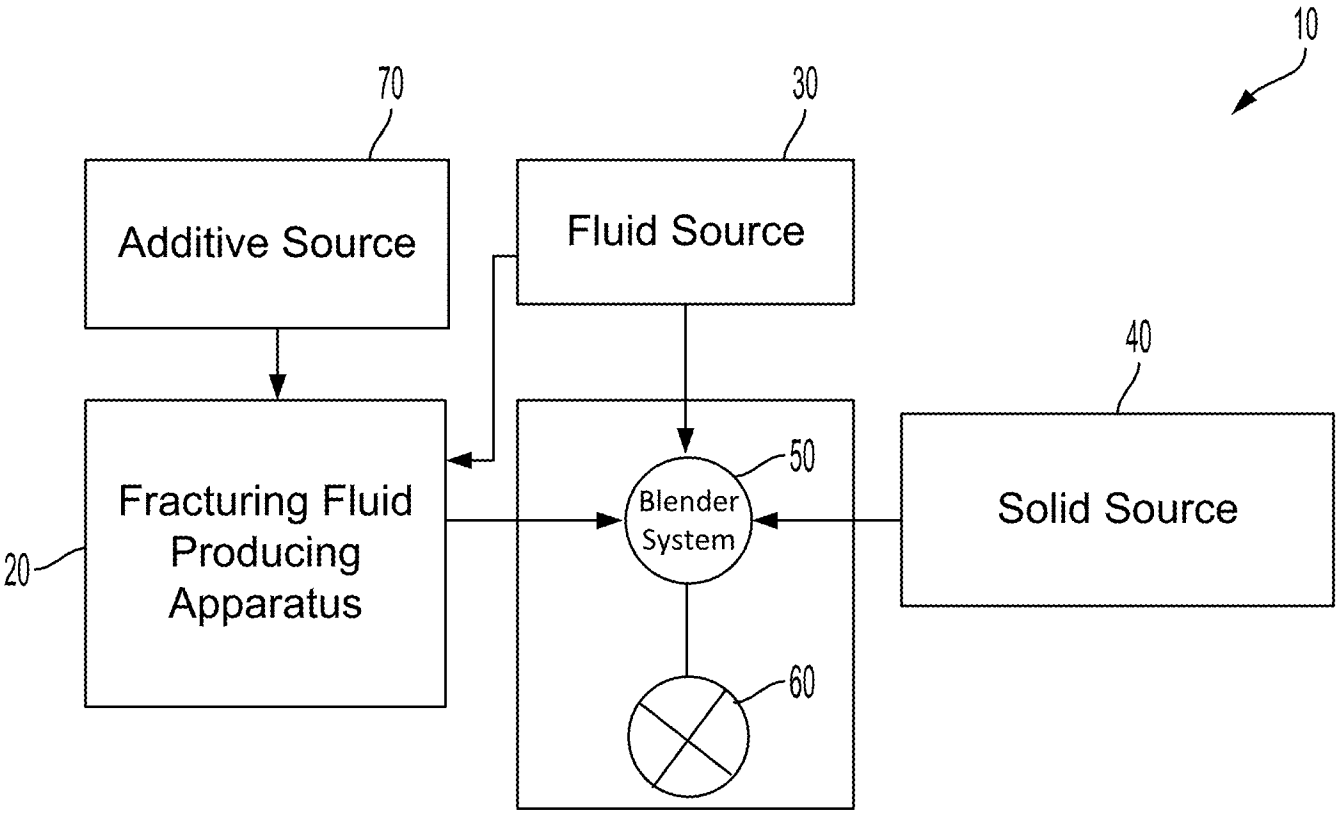
FIG. 1 illustrates a schematic diagram of an example fracturing system, in accordance with aspects of the present disclosure.

Various embodiments of the disclosure are discussed in detail below. While specific implementations are discussed, it should be understood that this is done for illustration purposes only. A person skilled in the relevant art will recognize that other components and configurations may be used without parting from the spirit and scope of the disclosure.

Additional features and advantages of the disclosure will be set forth in the description which follows, and in part will be obvious from the description, or can be learned by practice of the principles disclosed herein. The features and advantages of the disclosure can be realized and obtained by means of the instruments and combinations particularly pointed out in the appended claims. These and other features of the disclosure will become more fully apparent from the following description and appended claims or can be learned by the practice of the principles set forth herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the embodiments described herein.

In various embodiments, a computer-implemented method for optimizing multi-unit pumping operations at a well site. The computer-implemented method can include receiving sensor data from a hydraulic fracturing fleet equipment at an equipment system. The computer-implemented method can also include designating an event as being flagged based on the sensor data from the hydraulic fracturing fleet equipment. The computer-implemented method can further include determining a physical action based on the flagged event and a priority list of actions. The computer-implemented method can also include providing instructions to a first pump of the hydraulic fracturing fleet equipment to perform the physical action based on the flagged event and the priority list of actions.

In various embodiments, a system for optimizing multi-unit pumping operations at a well site can include one or more processors and at least one computer-readable storage medium having stored therein instructions which, when executed by the one or more processors, cause the system to receive sensor data from a hydraulic fracturing fleet equipment at an equipment system. The instructions can further cause the system to designate an event as being flagged based on the sensor data from the hydraulic fracturing fleet equipment. The instructions can also cause the system to determine a physical action based on the flagged event and a priority list of actions. The instructions can additionally cause the system to provide instructions to a first pump of the hydraulic fracturing fleet equipment to perform the physical action based on the flagged event and the priority list of actions.

In various embodiments, a non-transitory computer-readable storage medium comprising instructions stored the non-transitory computer-readable storage medium, the instructions, when executed by one or more processors, cause the one or more processors to receive sensor data from a hydraulic fracturing fleet equipment at an equipment system. The instructions can further cause the one or more processors to designate an event as being flagged based on the sensor data from the hydraulic fracturing fleet equipment. The instructions can also cause the one or more processors to determine a physical action based on the flagged event and a priority list of actions. The instructions can additionally cause the one or more processors to provide instructions to a first pump of the hydraulic fracturing fleet equipment to perform the physical action based on the flagged event and the priority list of actions.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative aspects but, like the illustrative aspects, should not be used to limit the present disclosure.

Referring to FIG. 1, an example fracturing system 10 is shown. The example fracturing system 10 shown in FIG. 1 can be implemented using the systems, methods, and techniques described herein. In particular, the disclosed system, methods, and techniques may directly or indirectly affect one or more components or pieces of equipment associated with the example fracturing system 10, according to one or more embodiments. The fracturing system 10 includes a fracturing fluid producing apparatus 20, a fluid source 30, a solid source 40, and a pump and blender system 50. All or an applicable combination of these components of the fracturing system 10 can reside at the surface at a well site/fracturing pad where a well 60 is located.

During a fracturing job, the fracturing fluid producing apparatus 20 can access the fluid source 30 for introducing/controlling flow of a fluid, e.g. a fracturing fluid, in the fracturing system 10. While only a single fluid source 30 is shown, the fluid source 30 can include a plurality of separate fluid sources. Further, the fracturing fluid producing apparatus 20 can be omitted from the fracturing system 10. In turn, the fracturing fluid can be sourced directly from the fluid source 30 during a fracturing job instead of through the intermediary fracturing fluid producing apparatus 20.

The fracturing fluid can be an applicable fluid for forming fractures during a fracture stimulation treatment of the well 60. For example, the fracturing fluid can include water, a hydrocarbon fluid, a polymer gel, foam, air, wet gases, and/or other applicable fluids. In various embodiments, the fracturing fluid can include a concentrate to which additional fluid is added prior to use in a fracture stimulation of the well 60. In certain embodiments, the fracturing fluid can include a gel pre-cursor with fluid, e.g. liquid or substantially liquid, from fluid source 30. Accordingly, the gel pre-cursor with fluid can be mixed by the fracturing fluid producing apparatus 20 to produce a hydrated fracturing fluid for forming fractures.

The solid source 40 can include a volume of one or more solids for mixture with a fluid, e.g. the fracturing fluid, to form a solid-laden fluid. The solid-laden fluid can be pumped into the well 60 as part of a solids-laden fluid stream that is used to form and stabilize fractures in the well 60 during a fracturing job. The one or more solids within the solid source 40 can include applicable solids that can be added to the fracturing fluid of the fluid source 30. Specifically, the solid source 40 can contain one or more proppants for stabilizing fractures after they are formed during a fracturing job, e.g. after the fracturing fluid flows out of the formed fractures. For example, the solid source 40 can contain sand.

The fracturing system 10 can also include additive source 70. The additive source 70 can contain/provide one or more applicable additives that can be mixed into fluid, e.g. the fracturing fluid, during a fracturing job. For example, the additive source 70 can include solid-suspension-assistance agents, gelling agents, weighting agents, and/or other optional additives to alter the properties of the fracturing fluid. The additives can be included in the fracturing fluid to reduce pumping friction, to reduce or eliminate the fluid's reaction to the geological formation in which the well is formed, to operate as surfactants, and/or to serve other applicable functions during a fracturing job. The additives can function to maintain solid particle suspension in a mixture of solid particles and fracturing fluid as the mixture is pumped down the well 60 to one or more perforations.

The pump and blender system 50 functions to pump fracture fluid into the well 60. Specifically, the pump and blender system 50 can pump fracture fluid from the fluid source 30, e.g. fracture fluid that is received through the fracturing fluid producing apparatus 20, into the well 60 for forming and potentially stabilizing fractures as part of a fracture job. The pump and blender system 50 can include one or more pumps. Specifically, the pump and blender system 50 can include a plurality of pumps that operate together, e.g. concurrently, to form fractures in a subterranean formation as part of a fracturing job. The one or more pumps included in the pump and blender system 50 can be an applicable type of fluid pump. For example, the pumps in the pump and blender system 50 can include electric pumps and/or hydrocarbon and hydrocarbon mixture powered pumps. Specifically, the pumps in the pump and blender system 50 can include diesel powered pumps, natural gas powered pumps, and diesel combined with natural gas powered pumps.

The pump and blender system 50 can also function to receive the fracturing fluid and combine it with other components and solids. Specifically, the pump and blender system 50 can combine the fracturing fluid with volumes of solid particles, e.g. proppant, from the solid source 40 and/or additional fluid and solids from the additive source 70. In turn, the pump and blender system 50 can pump the resulting mixture down the well 60 at a sufficient pumping rate to create or enhance one or more fractures in a subterranean zone, for example, to stimulate production of fluids from the zone. While the pump and blender system 50 is described to perform both pumping and mixing of fluids and/or solid particles, in various embodiments, the pump and blender system 50 can function to just pump a fluid stream, e.g. a fracture fluid stream, down the well 60 to create or enhance one or more fractures in a subterranean zone.

The fracturing fluid producing apparatus 20, fluid source 30, and/or solid source 40 may be equipped with one or more monitoring devices (not shown). The monitoring devices can be used to control the flow of fluids, solids, and/or other compositions to the pumping and blender system 50. Such monitoring devices can effectively allow the pumping and blender system 50 to source from one, some or all of the different sources at a given time. In turn, the pumping and blender system 50 can provide just fracturing fluid into the well at some times, just solids or solid slurries at other times, and combinations of those components at yet other times.

Figure 2:
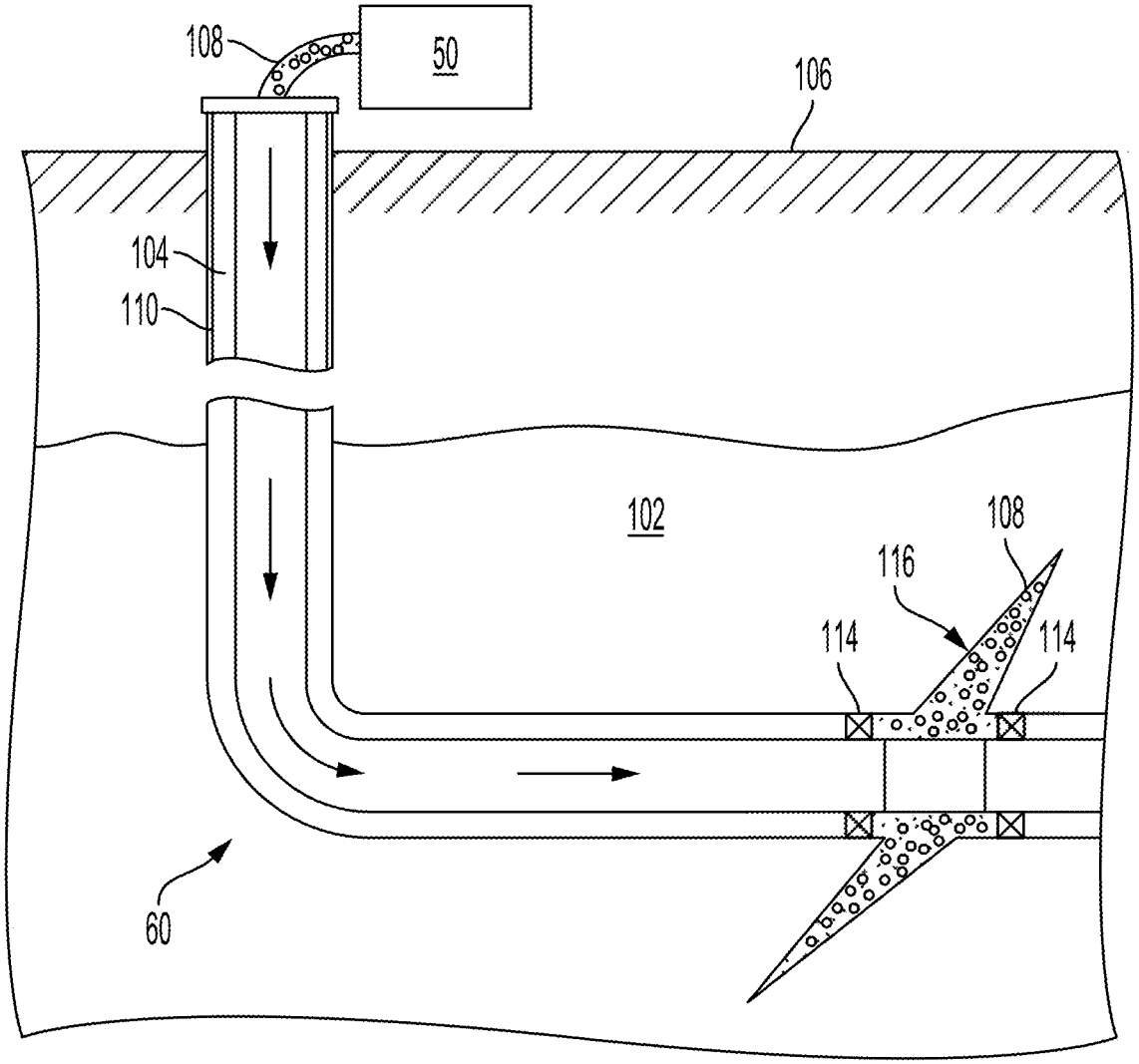
FIG. 2 illustrates a well during a fracturing operation in a portion of a subterranean formation of interest surrounding a wellbore, in accordance with aspects of the present disclosure.

FIG. 2 shows the well 60 during a fracturing operation in a portion of a subterranean formation of interest 102 surrounding a wellbore 104. The fracturing operation can be performed using one or an applicable combination of the components in the example fracturing system 10 shown in FIG. 1. The wellbore 104 extends from the surface 106, and the fracturing fluid 108 is applied to a portion of the subterranean formation 102 surrounding the horizontal portion of the wellbore. Although shown as vertical deviating to horizontal, the wellbore 104 may include horizontal, vertical, slant, curved, and other types of wellbore geometries and orientations, and the fracturing treatment may be applied to a subterranean zone surrounding any portion of the wellbore 104. The wellbore 104 can include a casing 110 that is cemented or otherwise secured to the wellbore wall. The wellbore 104 can be uncased or otherwise include uncased sections. Perforations can be formed in the casing 110 to allow fracturing fluids and/or other materials to flow into the subterranean formation 102. As will be discussed in greater detail below, perforations can be formed in the casing 110 using an applicable wireline-free actuation or a wireline that deploys perforation guns. In the example fracture operation shown in FIG. 2, a perforation is created between points 114.

The pump and blender system 50 is fluidly coupled to the wellbore 104 to pump the fracturing fluid 108, and potentially other applicable solids and solutions into the wellbore 104. When the fracturing fluid 108 is introduced into wellbore 104 it can flow through at least a portion of the wellbore 104 to the perforation, defined by points 114. The fracturing fluid 108 can be pumped at a sufficient pumping rate through at least a portion of the wellbore 104 to create one or more fractures 116 through the perforation and into the subterranean formation 102. Specifically, the fracturing fluid 108 can be pumped at a sufficient pumping rate to create a sufficient hydraulic pressure at the perforation to form the one or more fractures 116. Further, solid particles, e.g. proppant from the solid source 40, can be pumped into the wellbore 104, e.g. within the fracturing fluid 108 towards the perforation. In turn, the solid particles can enter the fractures 116 where they can remain after the fracturing fluid flows out of the wellbore. These solid particles can stabilize or otherwise "prop" the fractures 116 such that fluids can flow freely through the fractures 116.

While only two perforations at opposing sides of the wellbore 104 are shown in FIG. 2, as will be discussed in greater detail below, greater than two perforations can be formed in the wellbore 104, e.g. along the top side of the wellbore 104, as part of a perforation cluster. Fractures can then be formed through the plurality of perforations in the perforation cluster as part of a fracturing stage for the perforation cluster. Specifically, fracturing fluid and solid particles can be pumped into the wellbore 104 and pass through the plurality of perforations during the fracturing stage to form and stabilize the fractures through the plurality of perforations.

Figure 3:
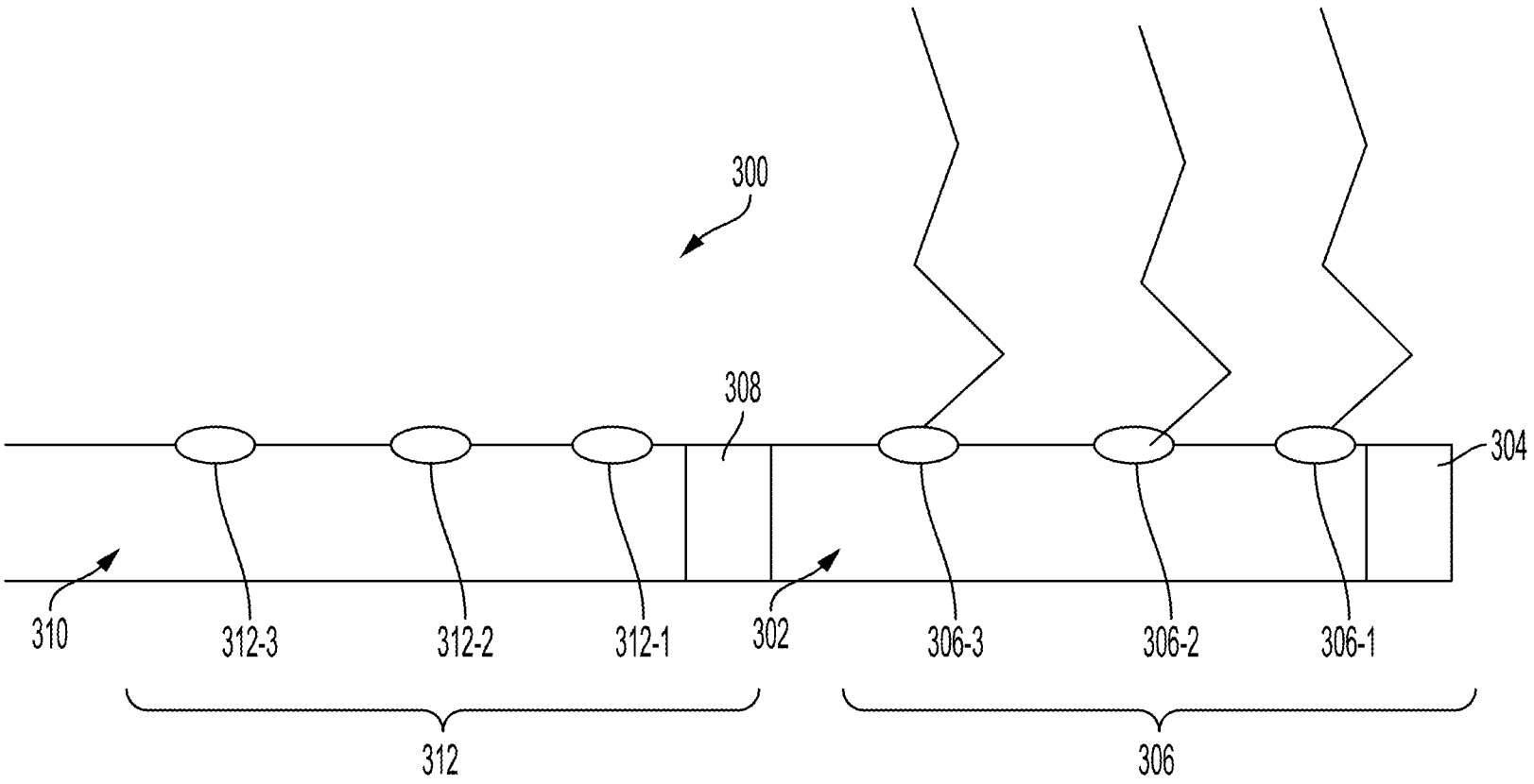
FIG. 3 illustrates a portion of a wellbore that is fractured using multiple fracture stages, in accordance with aspects of the present disclosure.

FIG. 3 shows a portion of a wellbore 300 that is fractured using multiple fracture stages. Specifically, the wellbore 300 is fractured in multiple fracture stages using a plug-and-perf technique.

The example wellbore 300 includes a first region 302 within a portion of the wellbore 300. The first region 302 can be positioned in proximity to a terminal end of the wellbore 300. The first region 302 is formed within the wellbore 300, at least in part, by a plug 304. Specifically, the plug 304 can function to isolate the first region 302 of the wellbore 300 from another region of the wellbore 300, e.g. by preventing the flow of fluid from the first region 302 to another region of the wellbore 300. The region isolated from the first region 302 by the plug 304 can be the terminal region of the wellbore 300. Alternatively, the region isolated from the first region 302 by the plug 304 can be a region of the wellbore 300 that is closer to the terminal end of the wellbore 300 than the first region 302. While the first region 302 is shown in FIG. 3 to be formed, at least in part, by the plug 304, in various embodiments, the first region 302 can be formed, at least in part, by a terminal end of the wellbore 300 instead of the plug 304. Specifically, the first region 302 can be a terminal region within the wellbore 300.

The first region 302 includes a first perforation 306-1, a second perforation 306-2, and a third perforation 306-3. The first perforation 306-1, the second perforation 306-2, and the third perforation 306-3 can form a perforation cluster 306 within the first region 302 of the wellbore 300. While three perforations are shown in the perforation cluster 306, in various embodiments, the perforation cluster 306 can include fewer or more perforations. As will be discussed in greater detail later, fractures can be formed and stabilized within a subterranean formation through the perforations 306-1, 306-2, and 306-3 of the perforation cluster 306 within the first region 302 of the wellbore 300. Specifically, fractures can be formed and stabilized through the perforation cluster 306 within the first region 302 by pumping fracturing fluid and solid particles into the first region 302 and through the perforations 306-1, 306-2, and 306-3 into the subterranean formation.

The example wellbore 300 also includes a second region 310 positioned closer to the wellhead than the first region 302. Conversely, the first region 302 is in closer proximity to a terminal end of the wellbore 300 than the second region 310. For example, the first region 302 can be a terminal region of the wellbore 300 and therefore be positioned closer to the terminal end of the wellbore 300 than the second region 310. The second region 310 is isolated from the first region 302 by a plug 308 that is positioned between the first region 302 and the second region 310. The plug 308 can fluidly isolate the second region 310 from the first region 302. As the plug 308 is positioned between the first and second regions 302 and 310, when fluid and solid particles are pumped into the second region 310, e.g. during a fracture stage, the plug 308 can prevent the fluid and solid particles from passing from the second region 310 into the first region 302.

The second region 310 includes a first perforation 312-1, a second perforation 312-2, and a third perforation 312-3. The first perforation 312-1, the second perforation 312-2, and the third perforation 312-3 can form a perforation cluster 312 within the second region 310 of the wellbore 300. While three perforations are shown in the perforation cluster 312, in various embodiments, the perforation cluster 312 can include fewer or more perforations. As will be discussed in greater detail later, fractures can be formed and stabilized within a subterranean formation through the perforations 312-1, 312-2, and 312-3 of the perforation cluster 312 within the second region 310 of the wellbore 300. Specifically, fractures can be formed and stabilized through the perforation cluster 312 within the second region 310 by pumping fracturing fluid and solid particles into the second region 310 and through the perforations 312-1, 312-2, and 312-3 into the subterranean formation.

In fracturing the wellbore 300 in multiple fracturing stages through a plug-and-perf technique, the perforation cluster 306 can be formed in the first region 302 before the second region 310 is formed using the plug 308. Specifically, the perforations 306-1, 306-2, and 306-3 can be formed before the perforations 312-1, 312-2, and 312-3 are formed in the second region 310. The perforations 306-1, 306-2, and 306-3 can be formed using a wireline-free actuation. Once the perforations 306-1, 306-2, and 306-3 are formed, fracturing fluid and solid particles can be transferred through the wellbore 300 into the perforations 306-1, 306-2, and 306-3 to form and stabilize fractures in the subterranean formation as part of a first fracturing stage. The fracturing fluid and solid particles can be transferred from a wellhead of the wellbore 300 to the first region 302 through the second region 310 of the wellbore 300. Specifically, the fracturing fluid and solid particles can be transferred through the second region 310 before the second region 310 is formed, e.g. using the plug 308, and the perforation cluster 312 is formed. This can ensure, at least in part, that the fracturing fluid and solid particles flow through the second region 310 and into the subterranean formation through the perforations 306-1, 306-2, and 306-3 within the perforation cluster 306 in the first region 302.

After the fractures are formed through the perforations 306-1, 306-2, and 306-3, the wellbore 300 can be filled with the plug 308. Specifically, the wellbore 300 can be plugged with the plug 308 to form the second region 310. Then, the perforations 312-1, 312-2, and 312-3 can be formed, e.g. using a wireline-free actuation. Once the perforations 312-1, 312-2, and 312-3 are formed, fracturing fluid and solid particles can be transferred through the wellbore 300 into the perforations 312-1, 312-2, and 312-3 to form and stabilize fractures in the subterranean formation as part of a second fracturing stage. The fracturing fluid and solid particles can be transferred from the wellhead of the wellbore 300 to the second region 310 while the plug 308 prevents transfer of the fluid and solid particles to the first region 302. This can effectively isolate the first region 302 until the first region 302 is accessed for production of resources, e.g. hydrocarbons. After the fractures are formed through the perforation cluster 312 in the second region 310, a plug can be positioned between the second region 310 and the wellhead, e.g. to fluidly isolate the second region 310. This process of forming perforations and forming fractures during a fracture stage, followed by plugging on a region by region basis can be repeated. Specifically, this process can be repeated up the wellbore towards the wellhead until a completion plan for the wellbore 300 is finished.

Figure 4:
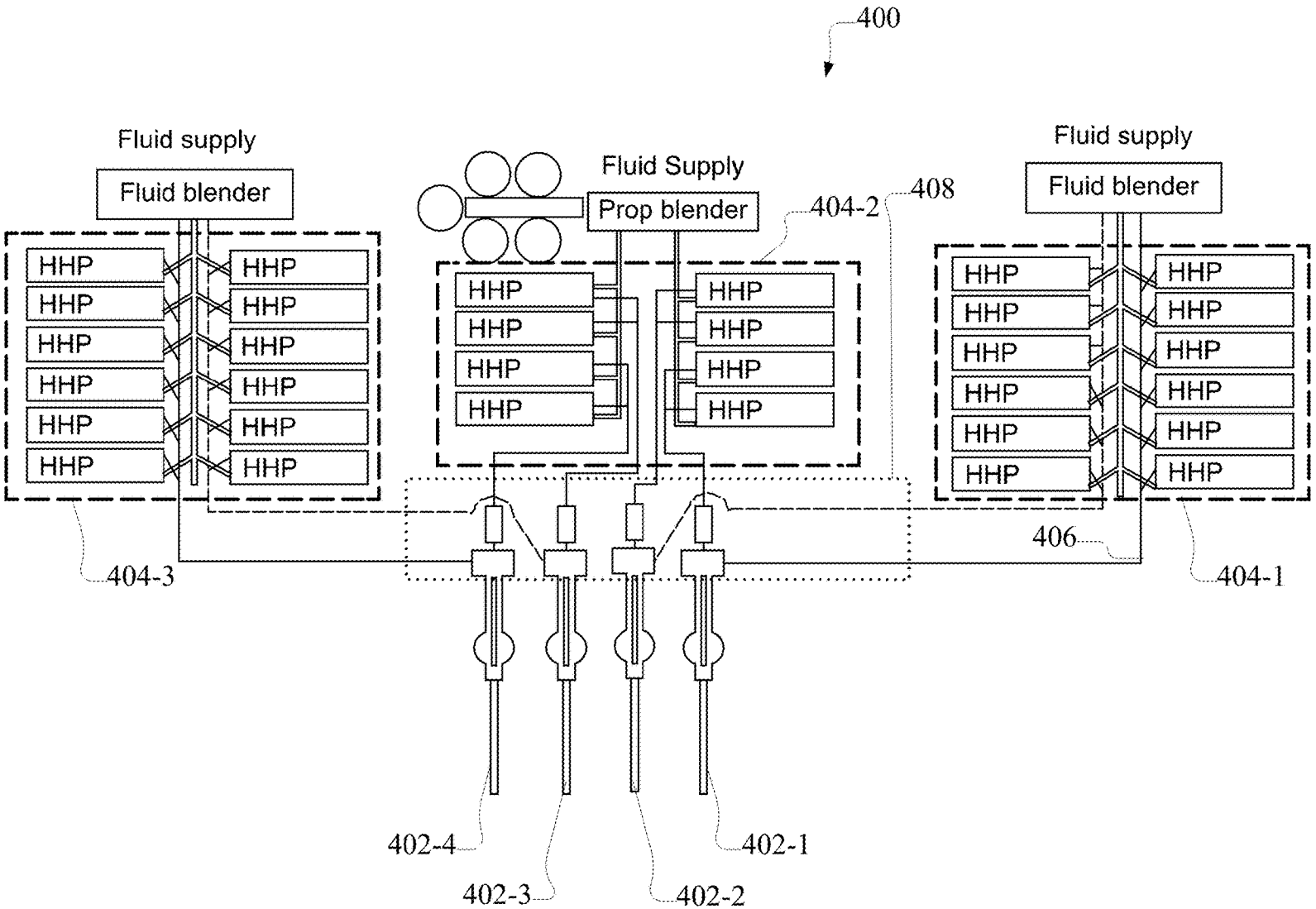
FIG. 4 illustrates an example fracturing system for concurrently performing fracturing stages in multiple wellbores, in accordance with aspects of the present disclosure.

FIG. 4 shows an example fracturing system 400 for concurrently performing fracturing stages in multiple wellbores. The example fracturing system 400 can be implemented using one or an applicable combination of the components shown in the example fracturing system 10 shown in FIG. 1. Further, the example fracturing system 400 can form fractures according to the example techniques implemented in the well 60 shown in FIG. 2 and the wellbore 300 shown in FIG. 3.

The example fracturing system 400 includes a first wellbore 402-1, a second wellbore 402-2, a third wellbore 402-3, and a fourth wellbore 402-4, collectively referred to as the wellbores 402. While four wellbores 402 are shown, the fracturing system 400 can include three or two wellbores, as long as the fracturing system 400 includes more than one wellbore. Further, the fracturing system 400 can include more than four wellbores.

The example fracturing system 400 also includes a first pump 404-1, a second pump 404-2, and a third pump 404-3, collectively referred to as a pumping system 404. While the pumping system is shown as including three separate pumps, the pumping system 404 can include fewer than three pumps or more than three pumps. For example, the pumping system 404 can include only a single pump. In some implementations, the first pump 404-1 can include a set of pumps where each block (HHP) can be one pump. Fluid coupling 406 (e.g., indicated by the solid line 406) can couple the six pumps (HHP) on the right side that feed fluid to the first wellbore 402-1. The second pump 404-2 can add proppant to the mix and be supported by the two lower right HHP blocks/pumps to the first well 402-1. In some examples, the fracturing system 400 can include eight sets of pumps that are correspondingly coupled to the four wellbores 402-1, 402-2, 402-3, 402-4. The pumping system 404 can also include three sets of pumps, where the first pump 404-1 includes two sets of pumps and the third pump 404-3 includes two sets of pumps that share a common fluid blender. The second pump 404-2 can include four sets of pumps that share a common proppant blender. In another example, eight sets of pumps can support four sets of wells, where each well is supported by one fluid pump set and one proppant pump set.

The pumping system 404 is fluidly connected to each of the wellbores 402. Specifically, the pumping system 404 can be fluidly connected to each of the wellbores 402, at least in part, through one or more fluid couplings, e.g. fluid coupling 406. In being fluidly connected to each of the wellbores 402, the pumping system 404 can pump fracturing fluid and solid particles, e.g. proppant, into the wellbores 402 for forming and stabilizing fractures through the wellbores 402. Specifically, the pumping system 404 can pump fracturing fluid and solid particles into the wellbores 402 for forming and stabilizing fractures through passages and/or perforations in the wellbores 402. The pumping system 404 can pump fracturing fluid into the wellbores 402 for forming fractures in the wellbores 402 according to the previously described plug-and-perf technique. Further, the pumping system 404 can pump solid particles, e.g. proppant, in a solid-laden fluid stream into the wellbores 402 for stabilizing the fractures according to the previously described plug-and-perf technique. In being fluidly connected to each of the wellbores 402, the pumping system 404 can pump additional components, e.g. additives, into the wellbores 402 for aiding in the formation and/or stabilization of fractures in the wellbores 402.

Figure 5:
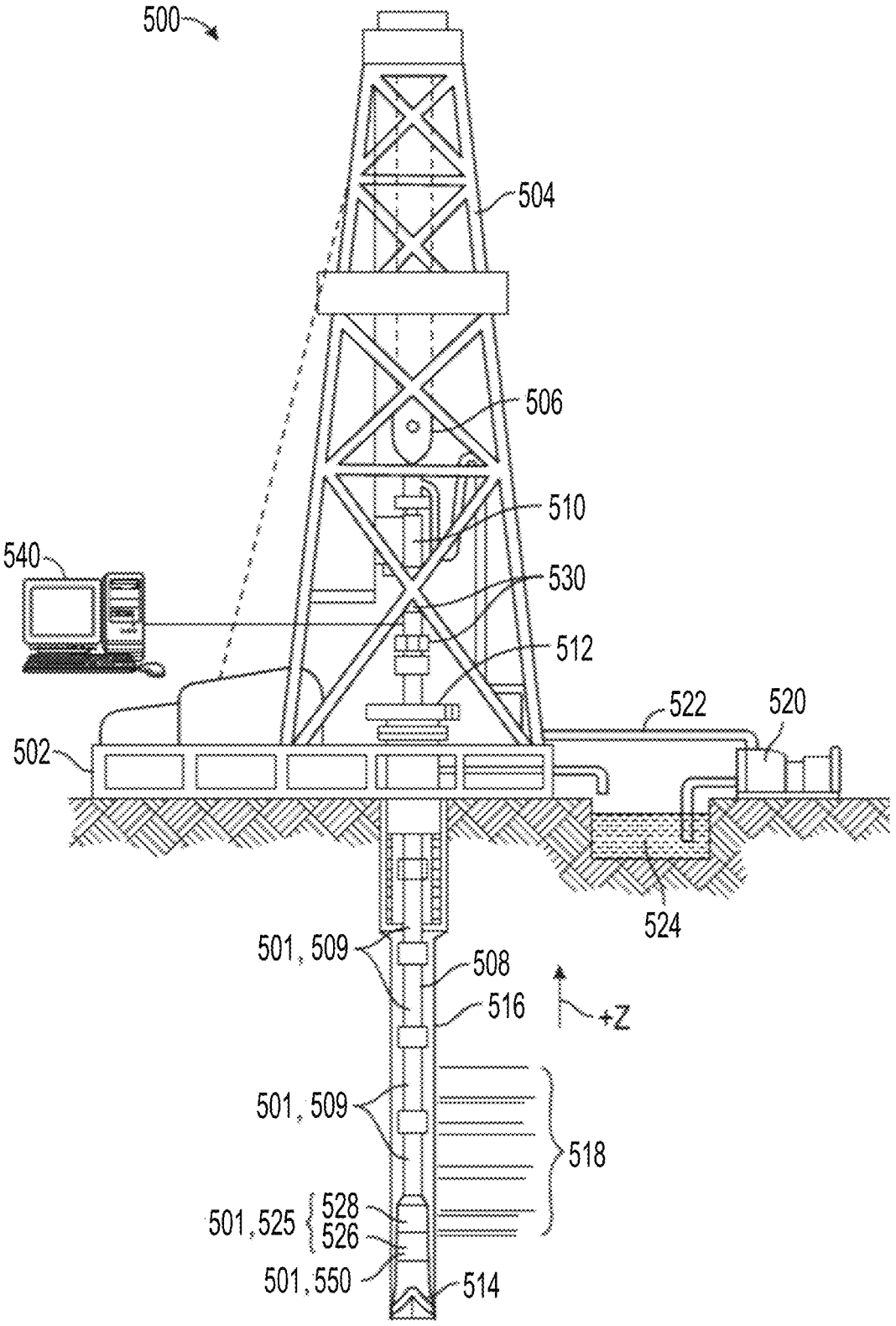
FIG. 5 illustrates an example diagram of an environment in which a drilling system may be used, in accordance with aspects of the present disclosure.

FIG. 5 illustrates a diagrammatic view of an example wellbore drilling environment 500, for example, a logging while drilling (LWD) and/or measurement while drilling (MWD) wellbore environment, in which the present disclosure may be implemented. As illustrated in FIG. 5, a drilling platform 502 is equipped with a derrick 504 that supports a hoist 506 for raising and lowering one or more drilling components 501 which can include, for example, a drill string 508 which can include one or more drill collars 509, a drill bit 514, and/or a bottom-hole assembly 525. The drilling components 501 are operable to drill a wellbore 516. The drilling components 501 also can include housings for one or more downhole tools. The drilling components 501 include at least one material having an actual yield strength. The actual yield strength can be determined and/or provided by the manufacturer of the drilling components 501. For example, the material of the drilling components 501 can be non-magnetic. In some examples, the material of the drilling components 501 can be stainless steel.

The hoist 506 suspends a top drive 510 suitable for rotating the drill string 508 and lowering the drill string 508 through the well head 512. Connected to the lower end of the drill string 508 is a drill bit 514. As the drill bit 514 rotates, the drill bit 514 creates a wellbore 516 that passes through various formations 518. A pump 520 circulates drilling fluid through a supply pipe 522 to top drive 510, down through the interior of drill string 508, through orifices in drill bit 514, back to the surface via the annulus around drill string 508, and into a retention pit 524. The drilling fluid transports cuttings from the wellbore 516 into the pit 524 and aids in maintaining the integrity of the wellbore 516. Various materials can be used for drilling fluid, including oil-based fluids and water-based fluids.

Referring to FIG. 5, sensors 526 can be provided, for example integrated into the bottom-hole assembly 525 near the drill bit 514. As the drill bit 514 extends the wellbore 516 through the formations 518, the sensors 526 can collect measurements of various drilling parameters, for example relating to various formation properties, the orientation of the drilling component(s) 501, dog leg severity, pressure, temperature, weight on bit, torque on bit, and/or rotations per minute. The sensors 526 can be any suitable sensor to measure the drilling parameters, for example transducers, fiber optic sensors, and/or surface and/or downhole sensors. The bottom-hole assembly 525 may also include a telemetry sub 528 to transfer measurement data to a surface receiver 530 and to receive commands from the surface. In some examples, the telemetry sub 528 communicates with a surface receiver 530 using mud pulse telemetry. In other examples, the telemetry sub 528 does not communicate with the surface, but rather stores logging data for later retrieval at the surface when the logging assembly is recovered. Notably, one or more of the bottom-hole assembly 525, the sensors 526, and the telemetry sub 528 may also operate using a non-conductive cable (e.g. slickline, etc.) with a local power supply, such as batteries and the like. When employing non-conductive cable, communication may be supported using, for example, wireless protocols (e.g. EM, acoustic, etc.) and/or measurements and logging data may be stored in local memory for subsequent retrieval at the surface.

Each of the sensors 526 may include a plurality of tool components, spaced apart from each other, and communicatively coupled with one or more wires. The telemetry sub 528 may include wireless telemetry or logging capabilities, or both, such as to transmit information in real time indicative of actual downhole drilling parameters to operators on the surface.

The sensors 526, for example an acoustic logging tool, may also include one or more computing devices 550 communicatively coupled with one or more of the plurality of drilling components 501. The computing device 550 may be configured to control or monitor the performance of the sensors 526, process logging data, and/or carry out the methods of the present disclosure.

In some examples, one or more of the sensors 526 may communicate with a surface receiver 530, such as a wired drillpipe. In other cases, the one or more of the sensors 526 may communicate with a surface receiver 530 by wireless signal transmission. In at least some cases, one or more of the sensors 526 may receive electrical power from a wire that extends to the surface, including wires extending through a wired drillpipe. In at least some examples the methods and techniques of the present disclosure may be performed by a controller 540, for example a computing device, on the surface. The controller 540 is discussed in further detail below. In some examples, the controller 540 may be included in and/or communicatively coupled with surface receiver 530. For example, surface receiver 530 of wellbore operating environment 500 at the surface may include one or more of wireless telemetry, processor circuitry, or memory facilities, such as to support substantially real-time processing of data received from one or more of the sensors 526. In some examples, data can be processed at some time subsequent to its collection, wherein the data may be stored on the surface at surface receiver 530, stored downhole in telemetry sub 528, or both, until it is retrieved for processing.

As understood by those of skill in the art, machine-learning based classification techniques can vary depending on the desired implementation. For example, machine-learning classification schemes can utilize one or more of the following, alone or in combination: hidden Markov models, recurrent neural networks (RNNs), convolutional neural networks (CNNs); Deep Learning networks, Bayesian symbolic methods, general adversarial networks (GANs), support vector machines, image registration methods, and/or applicable rule-based systems. Where regression algorithms are used, they can include but are not limited to: a Stochastic Gradient Descent Regressors, and/or Passive Aggressive Regressors, etc.

Machine learning classification models can also be based on clustering algorithms (e.g., a Mini-batch K-means clustering algorithm), a recommendation algorithm (e.g., a Miniwise Hashing algorithm, or Euclidean Locality-Sensitive Hashing (LSH) algorithm), and/or an anomaly detection algorithm, such as a Local outlier factor. Additionally, machine-learning models can employ a dimensionality reduction approach, such as, one or more of: a Mini-batch Dictionary Learning algorithm, an Incremental Principal Component Analysis (PCA) algorithm, a Latent Dirichlet Allocation algorithm, and/or a Mini-batch K-means algorithm, etc.

Multiphase production profiling can be an essential component of a production management program. A production management program can incorporate multidisciplinary technologies. For example, each production management program can be unique and be designed exclusively for a reservoir of interest. One of the elements of production management can include production optimization. Production optimization can include early identification of inefficiencies when they occur. However, there are factors that can be challenging and hinder efforts to obtain desired results of the production management program. For example, insufficient surveillance data, in a timely manner, can be one of the factors that leads to a less effective production management program.

Production Logging Tools (PLT) can be utilized to address well surveillance in terms of multiphase production profiling. PLT may have limitations that can inhibit their use in some types of wells. Well completion types are an example of such a limitation. In some types of wells, PLT may be unable to be performed due to the complexity of the completion. Another limitation is the well intervention itself, which can pose a health, safety, and environment (HSE) risk. Moreover, the PLT can provide a snapshot of the well condition, as continuous monitoring of the dynamic nature of a well flow regime is not possible, which can introduce a fair degree of uncertainty in the reservoir surveillance data.

The disclosed technology can include continuous production monitoring that can provide several optimization opportunities such as minimizing water production through downhole or surface choking; improving oil/gas recovery through the adjustment of a choke size; identifying inefficient areas that may require improvement (e.g., workover/well intervention); reducing of reservoir water disposal when less water is produced; and reducing the cost associated with periodical PLT runs.

While PLT can deliver useful information relating to production data, the PLT may not be left in the well for a long period of time. In addition, PLT may not continuously measure entire producing intervals as PLT is a point sensor. For example, PLT may not be able to track entire reservoir production sensitivities to different flow regimes that are adjusted at a surface choke or at Interval Control Valves (ICV). Though smart wells are becoming more popular, they are still unable to provide fast manipulation of ICV's that result in production optimization.

As provided above, during hydraulic fracturing operations, a multi-unit pumping system, such as a fracturing spread including multiple pumps and blenders, may experience many events that can lead to safety concerns, damage to the equipment, performance failure of a job, and cost-inefficient processes to complete the job. These concerning events can stem from several different types of systems including: CAT engine issues, leaking pump valves, unstable engine revolutions, and transmission issues. Furthermore, multiple concerning events can occur at the same time within a particular system. Moreover, all of these events can last for long durations of time, overlap temporally with each other, and have different levels of severity or methods of mitigation. Also, business priorities may not be known or easily found by an operator or crew such as those related to costs, history with a customer, and historical use of units. The business priorities may also differ between the crew, the customer, and management, which may also change based on real-time market conditions or job geography. This myriad of issues distract the operator and crew and can lead to costly, improper decisions being made during real-time operations.

As such, a need exists for optimizing multi-unit pumping operations during hydraulic fracturing operations.

Figure 6:
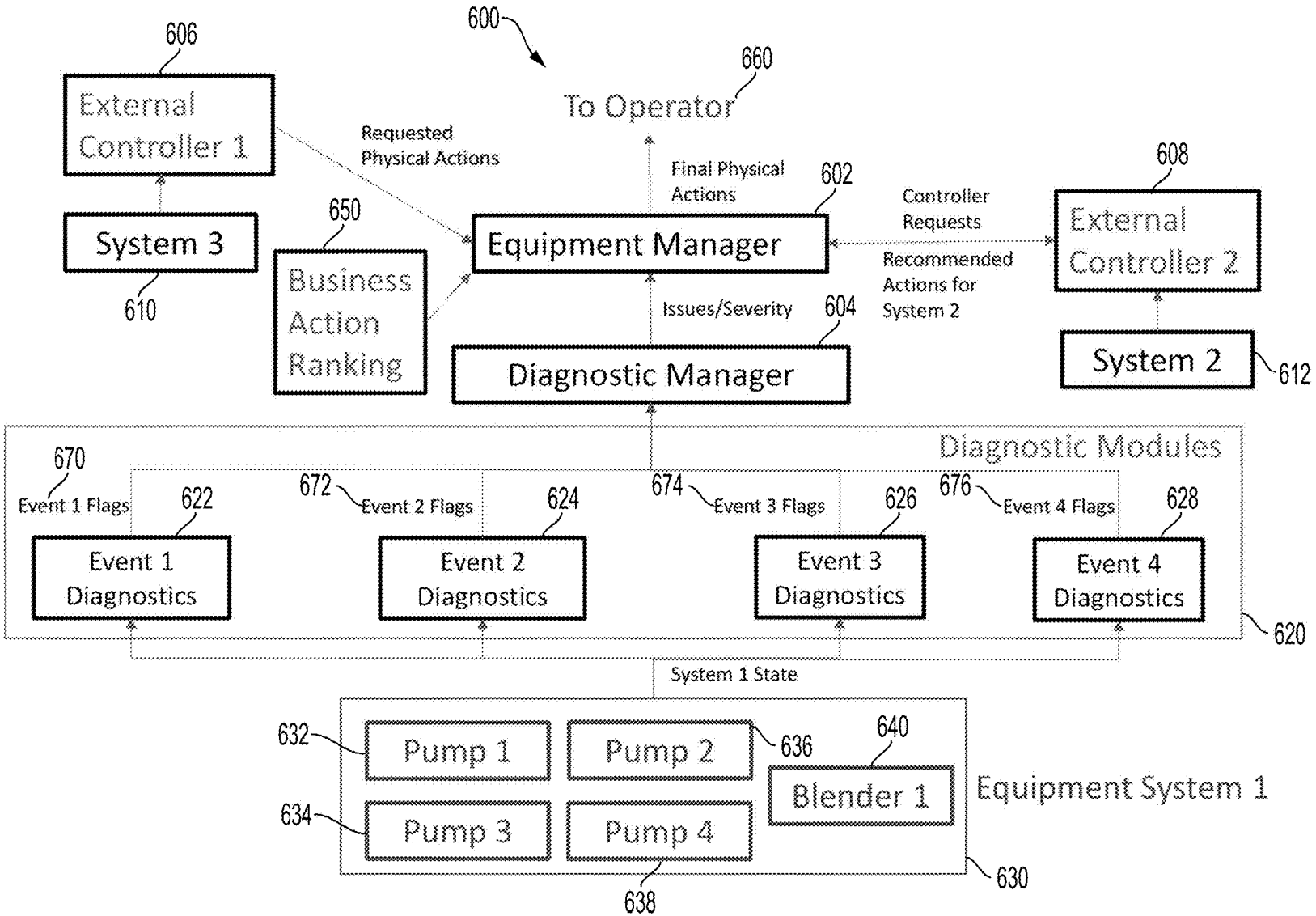
FIG. 6 illustrates an example diagram of a control system for hydraulic fracturing operations, in accordance with aspects of the present disclosure.
Figure 7:
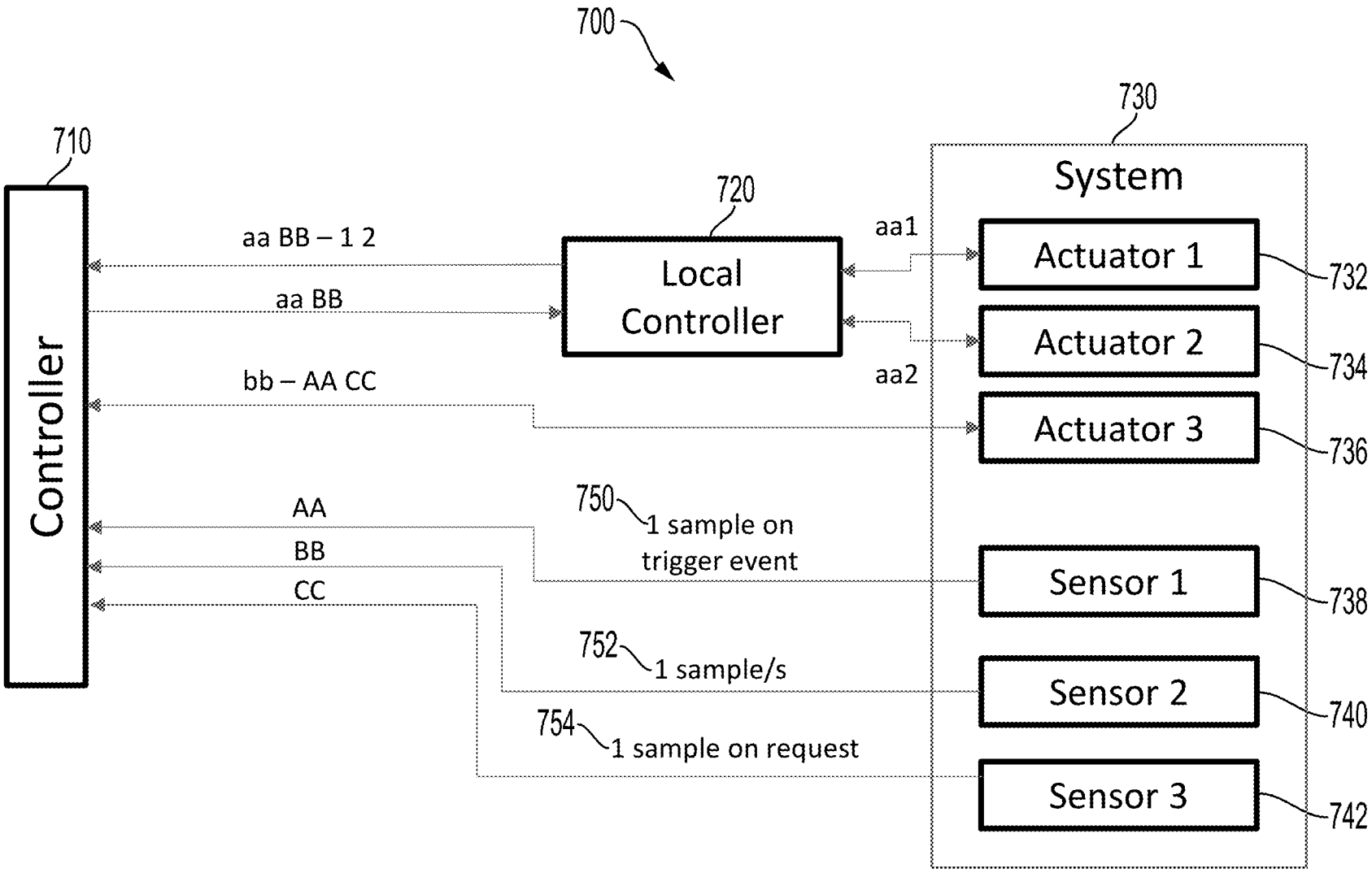
FIG. 7 illustrates an example controller system of utilizing asynchronous and synchronous messages, in accordance with aspects of the present disclosure.

FIG. 6 illustrates an example diagram of a control system for hydraulic fracturing operations 600, in accordance with aspects of the present disclosure. In some implementations, the control system 600 can include an equipment manager 602, a diagnostic manager 604, external controllers 606, 608, diagnostic modules 620, and an equipment system 630. In some examples, the external controllers 606, 608 can include respective systems 610, 612, as described herein. For example, systems 610, 612 can include actuators 732, 734, 736 and sensors 738, 740, 742 as shown in FIG. 7.

In some implementations, the diagnostic modules 620 can include event diagnostics 622, 624, 626, 628. The event diagnostics 622, 624, 626, 628 can be configured to receive data from the equipment system 630 to determine and generate event flags 670, 672, 674, 676, which can then be provided to the diagnostic manager 604. In some examples, the diagnostic modules 620 can be independent from other diagnostic modules 620 in the control system 600, which can allow the diagnostic modules 620 to be easily added, removed, modified from the control system 600 without shutting down the whole control system 600.

In other implementations, the equipment system 630 can include pumps 632, 634, 636, 638 and a blender 640, as described herein. Though only four pumps 632, 634, 636, 638 and one blender 640 are shown in FIG. 6, more or less pumps and blenders are contemplated in the present disclosure. Data obtained from the pumps 632, 634, 636, 638 and the blender 640 can then be provided to corresponding event diagnostics 622, 624, 626, 628 of the diagnostic modules 620 to perform diagnostic processes such as those related to flow rate, pressure, temperature, engine RPM, fluid levels, leakage rates, solids concentration, gas-oil ratio, viscosity, friction reducer concentration, fluid type, solids type, hours of equipment use, and equipment data.

In some examples, the equipment system 630 (e.g., Equipment System 1) can include the pumps 632, 634, 636, 638 and blenders 640 that have a current physical and status state of the pumps 632, 634, 636, 638 and blenders 640 at any given instance of time. The current physical and status states can include information such as engine RPM for Pump 1 632, an ECM code for Pump 2 636, whether a pump 632, 634, 636, 638 is using clean or dirty fluids, the amount of fluid within each pump 632, 634, 636, 638, and how much material (e.g., proppant) that is being blended in with the fluids leaving the pumps 632, 634, 636, 638. At set times, when requested or triggered by an external event, the full state of the equipment system 630 can be provided to the diagnostic modules 620.

In some examples, the event diagnostics 622, 624, 626, 628 can generate event flags 670, 672, 674, 676 based on the data from the pumps 632, 634, 636, 638 and the blender 640 of the equipment system 630. The event flags 670, 672, 674, 676 of the diagnostic modules 620 can include data and information indicating that the pumps 632, 634, 636, 638 or the blender 640 of the equipment system 630 are not performing at an optical or desired level, anonymous engine deviation when engine RPM varies more than an expected amount, low level of engine fluid indicating a leak, engines overheating, low pressure, and low solids rate. The diagnostic modules 620 can then provide the event flags 670, 672, 674, 676 to the diagnostic manager 604 for diagnostic purposes.

In some implementations, the diagnostic modules 620 can determine if an event of note occurred in the equipment system 630. For example, the events of note can include dynamic changes to the whole control system 600 (e.g., an engine experiencing RPM amplitude changes, ten times more extreme than normal) and static events such as an error code being present for more than 10 minutes. These events can be related to physical properties of the equipment (e.g., systems 610, 612, 630), such as engine RPM, an amount of fluid in the pump 632, 634, 636, 638, status of the equipment (e.g., a transmission condition monitoring code), and user activity (e.g., a valve being closed). Both of the current and past system states or portions of the past system state can be used to examine the event of note by the control system 600.

In other implementations, when an event occurs (e.g., as noted by a flag 670, 672, 674, 676), the diagnostic modules 620 can provide information relating to the event to the diagnostic manager 604. The diagnostic manager 604 can then correlate the event flag 670, 672, 674, 676 with a list of undesired operations that have occurred at the equipment system 1 630. For example, a particular volume of fluid in a pump tank can correspond to a cavitation event. Another example can include a sudden voltage drop at a sensor in the engine that corresponds to a corroded spark plug. Yet another example can include operations from distinct units with the control system 600 that when examined, individually, appear within acceptable operating limits. However, when combined, the operations from the distinct units may be outside operating limits. For example, two pumps 632, 634, 636, 638 can be providing the same flow rate as one another. However, one pump may be pumping produced water while the other pump may be pumping fresh water. This example can provide an unacceptable ratio of fresh water to produced water (assuming only 10% produced water was desired). In response, the diagnostic manager 604 can issue a notification to the equipment manager 602 indicating that the triggered event has occurred.

As multiple events can be triggered concurrently or approximately concurrently, the diagnostic manager 604 can notify the equipment manager 602 of all these events simultaneously, batched together in a time-gated process, or upon request from the equipment manager 602. The diagnostic manager 604 can further provide the equipment manager 602 with meta-data related to the event, such as a recommended action, a duration of the event, unit(s) the event is tied to, and selected statuses or physical values of the physical systems related to the event.

In some implementations, the equipment manager 602 can receive the list of events along with corresponding meta-data that may be related to the events. The equipment manager 602 can also determine if, when, and how to change physical operations (e.g., flow rate, pressure, RPM settings) of the equipment (e.g., the pumps 632, 634, 636, 638 and the blender 640) of the equipment system 1 630 to stop triggering the unwanted event. In addition to the list of events for the equipment system 1 630, information from other equipment systems 610, 612, controllers 606, 608, and operational objectives from businesses 650 can be utilized in consideration of changing physical operations of the equipment of the equipment system 1 630. A rating system can be used to prioritize the event to be dealt with or prioritize any recommendations.

In other implementations, the control system 600 can include a rating system that can be provided by a user on site, a remote operator, or an algorithm (e.g., techniques such as clustering, neural networks, and other machine learning and deep learning approaches including using feedback, severity/probability/cost ranking, or other approaches suitable for the intended purpose and understood by a person of ordinary skill in the art). Upon determining if and when a change to the physical operation may occur, the equipment manager 602 can determine the best method and time to undergo such an operation. For example, a total flow rate may be increased by 20%, but the equipment manager 602 may determine that it is more cost effective (e.g., implementing a final physical action) to increase the flow rate of a first pump by 30%, a second pump by 20%, and all other pumps by 10%. The equipment manager 602 may then provide the final physical action to the operator 660 or an operator's device by automatically undertaking the final physical action or as a recommendation that the operator 660 may approve.

In some examples, events, recommendations, and final actions, as described herein, can be recorded and displayed both locally and remotely for use in real-time operational and logistical decision making by the control system 600. For example, if a valve appears to be close to failing, not only can a notification be sent to an operator 602 and a regional manager, but a purchase request for a new valve may also be automatically placed for delivery either to the job site, a work camp, or a repair yard/center.

In other examples, the diagnostic manager 604 can receive the event flags 670, 672, 674, 676 from the diagnostic modules 620 and determine whether there is an issue with one of the corresponding pumps 632, 634, 636, 638 and blender 640 of the equipment system 630. For example, the diagnostic manager 604 can determine the severity of the issue with one of the corresponding pumps 632, 634, 636, 638 and blender 640 of the equipment system 630, pump failure, and improper clean/dirty flow ratio. If the flow rate of the pumps 632, 634, 636, 638 is too high or low, or if the blender 640 is providing incorrect amounts of liquid, the issues determined by the diagnostic manager 604 can be provided to the equipment manager 602 for further action.

In some implementations, the equipment manager 602 can further receive data or information from the external controllers 606, 608 and the systems 610, 612, as also described in FIG. 7. For example, the equipment manager 602 can receive requested physical actions from the external controller 1 606 and the system 3 610. The equipment manager 602 can further receive and provide controller requests and recommended actions with the external controller 2 608 and the system 2 612.

In other implementations, the equipment manager 602 can further receive instructions or information relating to business action rankings 650. For example, the equipment manager 602 can be configured to provide priority to certain actions based on the business action rankings 650. The equipment manager 602 can be preconfigured with a priority list or provided with instructions along with the business action rankings 650 when the business action rankings 650 is received. A hierarchy listing of the business action rankings 650 can provide priority of particular actions to be performed before other actions listed in the hierarchical order. For example, the business action rankings 650 can include rankings based on a level of authority such as a county manager versus a regional manager. In such an example, if the instructions provided by the county manager conflicts with the instructions provided by the regional manager, the instructions of the county manager will be accepted and procured by the equipment manager 602 if the county manager has a higher priority than the regional manager. The business action rankings 650 can further include utilizing information and data relating to: pumps with greater hours of use that can have reduced pressures and flow rates to ease use, additives that are less expensive that can be used instead of additives that are more effective, and priorities that can be switched if the client decides to augment a contract.

In some implementations, the control system 600 can also evaluate an operational status of equipment (e.g., the equipment system 630) and take actions (e.g., alerting an operator 660, adjusting a flow rate distribution among a fleet of pumps 632, 634, 636, 638, and automatically taking a pump 632, 634, 636, 638 offline). For example, the control system 600 can take certain actions based on a contemporaneous state of an entire pumping system (e.g., equipment system 630) and ranking of business priorities 650. Additionally, during hydraulic fracturing operations, the ranking of business priorities 650 can be adjusted in real-time and by an authorized manager (e.g., the equipment manager 602) from a secure remote location.

The control system 600 can evaluate an entire multi-unit pumping system (e.g., equipment system 630) simultaneously to determine actions that can be taken on individual components of the control system 600 including incorporating business-derived concerns in view of physical automation actions to be taken by the control system 600. Some of the benefits of the control system 600 can include protecting crew members, equipment, and the job site automatically. The control system 600 can also adjust operations as new real-time physical (e.g., from the external controllers 606, 608) and business knowledge (e.g., from the business action ranking 650) becomes available to the control system 600.

In some implementations, the diagnostic modules 604 can be a part of the diagnostic manager 604. The diagnostic modules 6020 can further be a part of each piece of equipment (e.g., the pumps 632, 634, 636, 638 and the blender 640) in the equipment system 630. As described herein, any components of the control system 600 can be deployed at a location on the equipment itself, as a standalone computer, or remotely with system states and final physical actions being communicated between the job location and the remote location. Fourier, Wavelet, and other harmonic analysis of time series can also be used for signal analysis, such as denoising or for multi-resolution analysis, to determine system misbehavior.

FIG. 7 illustrates an example controller system of utilizing asynchronous and synchronous messages 700, in accordance with aspects of the present disclosure. In some implementations, the controller system 700 can include a controller 710, a local controller 720, and a system 730. In some examples, the system 730 can include actuators 732, 734, 736 and sensors 738, 740, 742 that can be connected to devices such as pumps 632, 634, 636, 638 and blenders 640 as described in FIG. 6. In other examples, the local controller 720 can be positioned approximate to or within the system 730.

During hydraulic fracturing operations, a multi-unit pumping system, such as a fracturing spread including multiple pumps and blenders, can send telemetry information between a variety of units with different requirements relating to the frequency of communication. Previously, to control the multi-unit pumping system, a commander requires constant synchronous, two-way communication between multiple systems to ensure the safety of the crew and equipment. However, the data supplied to the commander by the multiple systems is often asynchronous, leading to potential inconsistencies in the known state of the system, which can lead to hazardous and costly decisions by an automated system.

In some implementations, the controller system 700 can reconcile asynchronous data arriving from the sensors 738, 740, 742 and other system status information (e.g., from the actuators 732, 734, 736) for synchronous coordination with controls of the controller system 700. For example, the controller system 700 can utilize unique identifiers (e.g., AA, aa, BB, bb, CC, cc, etc.) for each control series to ensure grouping of asynchronistic and synchronistic data (e.g., from the sensors 738, 740, 742 and the actuators 732, 734, 736, respectively). In some implementations, the controller system 700 can utilize a centralized processor for control or be an independent controller system that can self-diagnose and control a system, which can be distributed across multiple units or remotely.

The controller system 700 can reconcile synchronous and asynchronous data inputs and control requirements. The controller system 700 can also distribute control among multiple units (e.g., system 730), locally and remotely, stabilize control architecture, and adjust accordingly when a unit (e.g., system 730) is disconnected from the network of the controller system 700.

In some implementations, for an asynchronous protocol, timing for receiving data can be flexible. For example, data can be provided and received based on a pre-defined trigger event 750 (e.g., 1 sample on a trigger event, Sensor 1 738), a pre-defined rate 752 (e.g., 1 sample(s), Sensor 2 740), or on a request 754 (e.g., 1 sample on request, Sensor 3 742). Conversely, to ensure a known state, commands from the controller 710 can require synchronicity for any handshaking between the controller 710 and the actuators 732, 734, 736. For example, several commands can be issued from the controller 710 to the actuators 732, 734, 736 in a short period of time. If the operations (e.g., the several commands) take different amounts of time for each actuator 732, 734, 736 to accomplish, completion messages can be returned to the controller 710 in an order that is different from when the initial commands were provided to the actuators 732, 734, 736. To determine which messages came from which of the actuators 732, 734, 736, the controller system 700 can utilize unique identifiers to track the origin and progress of each command and response mechanism.

Referring to FIG. 7, the controller system 700 can utilize unique message tags to marry asynchronous and synchronous messages between the controller 710 and the system 730. Each piece of data between the controller 710 and the system 730 can include a unique identifier (e.g., AA can be associated with data for Sensor 1 738, BB can be associated with data for Sensor 2 740, and CC can be associated with data for Sensor 3 742) to enable tracking of the data. The data between the controller 710 and the system 730 can further include additions or changes to the unique identifiers to track the status of the message (e.g., CC response to CC request). Similarly, each command/response message can also be associated with its own tag (e.g., aa or bb) or unique identifier to allow tracking of each message between the controller 710 and the system 730. Examples of utilizing the unique identifiers of the controller system 700 include:

1) Sensor 1 738 provides a data sample AA relating to a triggered event 750 such as a pressure of a pump going beyond a pre-determined threshold. Simultaneously, the controller 710 can request valve health information from Sensor 3 742, which the Sensor 3 742 can receive as a message CC. In the example, the controller 710 can receive both of the data sample AA and the message CC simultaneously, which may cause the controller 710 to issue requests bb (e.g., relating to data sample AA and message CC as "bb— AA CC") to open a valve to release pressure at Actuator 3 736. In this example, the Actuator 3 736 can receive multiple instructions from the controller 710: 1) instructions to open the value due to the data sample AA received from the Sensor 1 738; and 2) instructions to keep the valve at the Actuator 3 736 in its current position, indefinitely, due to the message CC from the Sensor 3 742. As such, the Actuator 3 736 can receive both requests and responses. However, it is unclear in this example if the response AA from the Sensor 1 738 or the response CC from the Sensor 3 742 occurred first, which can leave the controller system 700 in two different states (e.g., one state with an indefinitely opened valve and another state with a valve that is partially opened, indefinitely). As described herein, the controller 710 of the controller system 700 can utilize unique identifiers/tags that can be used for the data event (e.g., the data sample AA and the message CC), which can be added and used both for sending a command and for receipt of a response.

2) Sensor 2 740 provides data BB to the controller 710 once per second 754 (e.g., a pre-determined pump rate). The controller 710 can then provide commands aa to the system 730 (e.g., as "aa BB") to maintain a specific pump rate for two pumps (e.g., one pump controlled by Actuator 1 732 and another pump controlled by Actuator 2 734). The controller 710 can provide the message (e.g., command aa BB) to the local controller 720 with the unique tag aa BB, which can then provide the corresponding message to the Actuators 732, 734. In the example where a local controller is available, the message can also indicate which of the Actuators 732, 734 to provide the message to, such as "aa BB—1 2." The message "aa BB—1 2" can indicate to the local controller 720 that message aa BB is to be provided to Actuator "1" 732 and Actuator "2" 734. The local controller 720 can also enable a PID feedback algorithm (e.g., a proportional, an integral, or a derivative controller) to maintain the pump rates at the Actuators 732, 734. Each of the Actuators 732, 734 can also provide their respective status information to the controller 710 of the controller system 700 as confirmation. In other examples, the additions of tags "1" and "2" to the unique message/tag (e.g., message "aa BB") can inform the controller 710 that the command aa BB has been received and that the Actuators 732, 734 have acted accordingly pursuant to the instructions in the message aa BB.

In some implementations, the controller system 700 can utilize multiple identifiers within each data message, command, request, or response. For example, one identifier can track a message as a whole (e.g., as described above), while another identifier can track how many operations have been taken in the message. In some implementations, an identifier can also be incremented during each operation and serve as a checksum to ensure that it matches with what the program expects. This identifier can also be equipment agnostic, and rather, depend on a number of operations. The use of multiple identifiers can enable greater ease of following the process of a command and its effects for easier debugging at a future time. For example, the changes in the identifier can be tracked and formed into a log that can be utilized at a future time. The state when an issue occurs and the pattern of states before can also be examined to determine whether anything foreshadows a possible issue. In some examples, the identifiers can be unique to a particular equipment, system type, measurement type, date/time, or any combination thereof, and include metadata such as information relating to crew members, operators, customer information, and well site/location. Unique combinations of status flags can also be used as identifiers by the controller system 700.

Figure 8:
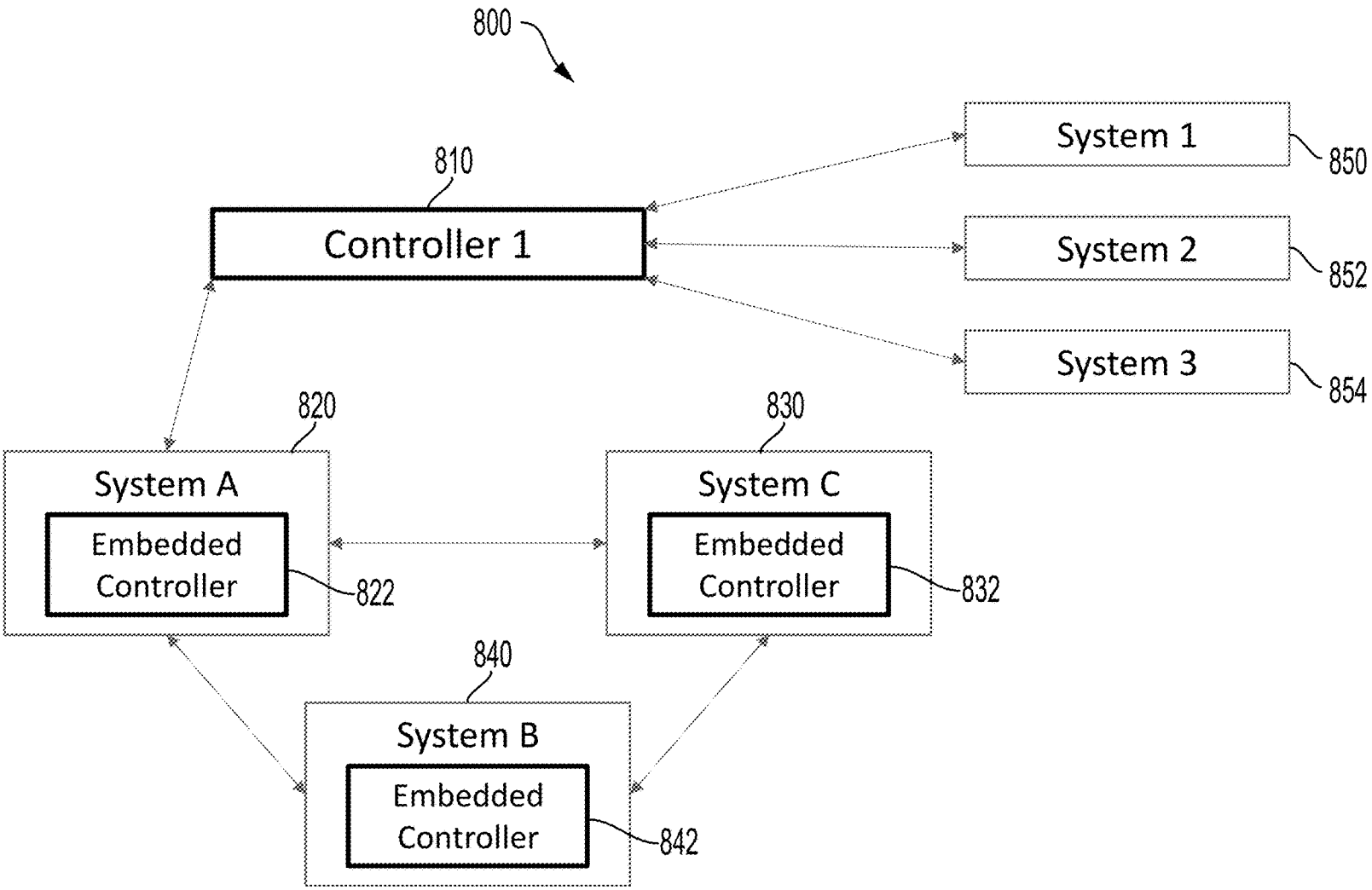
FIG. 8 illustrates an example distributed system of utilizing asynchronous and synchronous messages, in accordance with aspects of the present disclosure.

FIG. 8 illustrates an example distributed system of utilizing asynchronous and synchronous messages 800, in accordance with aspects of the present disclosure. For example, the distributed system 800 can be extended in a distributed manner (e.g., in view of the controller system 700 of FIG. 7) as shown in FIG. 8. In some implementations, the distributed system 800 can include a controller 810 and systems 820, 830, 840, 850, 852, 854. In some examples, the system A 820 can include an embedded controller 822, the system B 840 can include an embedded controller 842, and the system C 830 can include an embedded controller 832.

Figure 9:
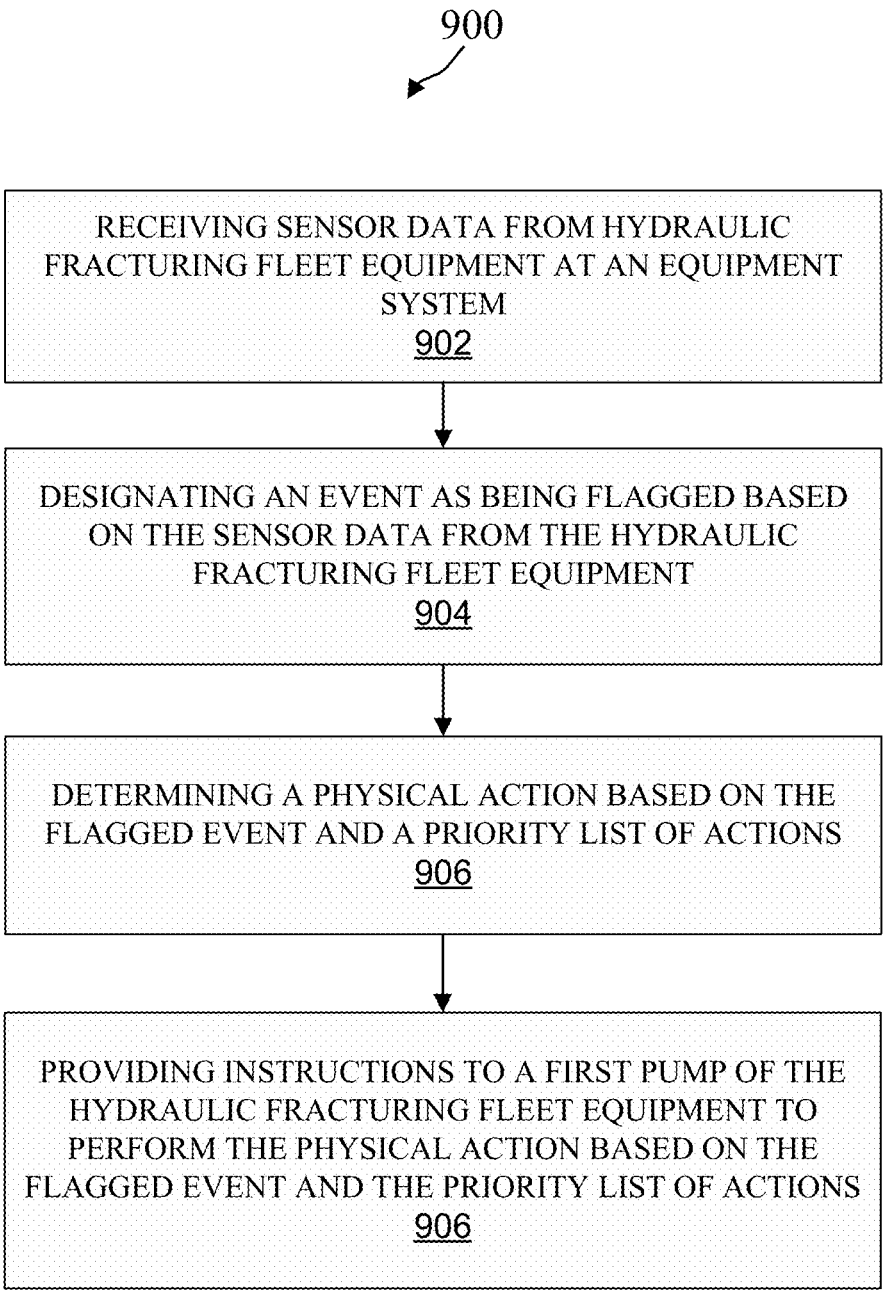
FIG. 9 shows an example process for optimizing multi-unit pumping operations, in accordance with aspects of the present disclosure.

Having disclosed some example system components and concepts, the disclosure now turns to FIG. 9, which illustrate example method 900 for optimizing multi-unit pumping operations. The steps outlined herein are exemplary and can be implemented in any combination thereof, including combinations that exclude, add, or modify certain steps.

At step 902, the method 900 can include receiving sensor data from hydraulic fracturing fleet equipment (e.g., a plurality of pumps, blenders, wellhead, etc.) at an equipment system. In some implementations, in addition to the sensor data being from the hydraulic fracturing fleet equipment, the sensor data can include data from blenders, downhole sensors and tools, surface sensor systems at a wellhead, and external sensor systems such as a surface Microseismic array and tiltmeters, or with sensors monitoring a crew, operator, or weather conditions.

At step 904, the method 900 can include designating an event as being flagged based on the sensor data from the hydraulic fracturing fleet equipment. The designating of the event as being flagged can indicate that the event has breached an optimum range of operation.

At step 906, the method 900 can include determining a physical action based on the flagged event and a priority list of actions. The physical action can indicate an adjustment of a parameter of at least one of the hydraulic fracturing fleet equipment.

At step 908, the method 900 can include providing instructions to a first pump of the hydraulic fracturing fleet equipment to perform the physical action based on the flagged event and the priority list of actions.

The method 900 can further include updating the priority list of actions based on receiving new instructions that rearrange, augment, or reduce the priority list of actions.

The method 900 can additionally include receiving a first asynchronous message including a first unique asynchronous message identifier from the first pump of the hydraulic fracturing fleet equipment, and providing a synchronous message including a unique synchronous message identifier to at least one actuator based on the first asynchronous message including the first unique asynchronous message identifier.

The method 900 can also include receiving a second asynchronous message including a second unique asynchronous message identifier from a second pump of the hydraulic fracturing fleet equipment. The first unique asynchronous message identifier of the first asynchronous message can be different from the second unique asynchronous message identifier of the second asynchronous message.

Figure 10:
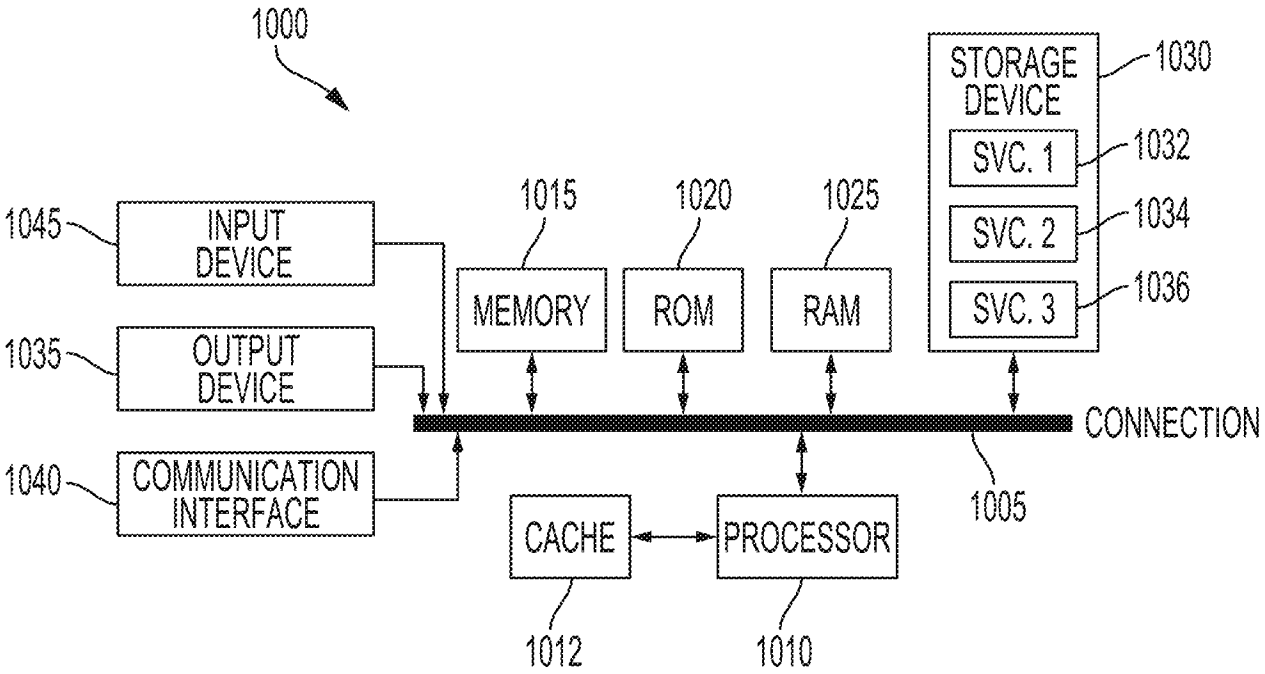
FIG. 10 illustrates an example computing device architecture that can be employed to perform various steps, methods, and techniques disclosed herein.

FIG. 10 illustrates an example computing device architecture 1000, which can be employed to perform various steps, methods, and techniques disclosed herein. The various implementations will be apparent to those of ordinary skill in the art when practicing the present technology. Persons of ordinary skill in the art will also readily appreciate that other system implementations or examples are possible.

As noted above, FIG. 10 illustrates an example computing device architecture 1000 of a computing device, which can implement the various technologies and techniques described herein. The components of the computing device architecture 1000 are shown in electrical communication with each other using a connection 1005, such as a bus. The example computing device architecture 1000 includes a processing unit (CPU or processor) 1010 and a computing device connection 1005 that couples various computing device components including the computing device memory 1015, such as read only memory (ROM) 1020 and random access memory (RAM) 1025, to the processor 1010.

The computing device architecture 1000 can include a cache of high-speed memory connected directly with, in close proximity to, or integrated as part of the processor 1010. The computing device architecture 1000 can copy data from the memory 1015 and/or the storage device 1030 to the cache 1012 for quick access by the processor 1010. In this way, the cache can provide a performance boost that avoids processor 1010 delays while waiting for data. These and other modules can control or be configured to control the processor 1010 to perform various actions. Other computing device memory 1015 may be available for use as well. The memory 1015 can include multiple different types of memory with different performance characteristics. The processor 1010 can include any general purpose processor and a hardware or software service, such as service 1 1032, service 2 1034, and service 3 1036 stored in storage device 1030, configured to control the processor 1010 as well as a special-purpose processor where software instructions are incorporated into the processor design. The processor 1010 may be a self-contained system, containing multiple cores or processors, a bus, memory controller, cache, etc. A multi-core processor may be symmetric or asymmetric.

To enable user interaction with the computing device architecture 1000, an input device 1045 can represent any number of input mechanisms, such as a microphone for speech, a touch-sensitive screen for gesture or grail input, keyboard, mouse, motion input, speech and so forth. An output device 1035 can also be one or more of a number of output mechanisms known to those of skill in the art, such as a display, projector, television, speaker device, etc. In some instances, multimodal computing devices can enable a user to provide multiple types of input to communicate with the computing device architecture 1000. The communications interface 1040 can generally govern and manage the user input and computing device output. There is no restriction on operating on any particular hardware arrangement and therefore the basic features here may easily be substituted for improved hardware or firmware arrangements as they are developed.

Storage device 1030 is a non-volatile memory and can be a hard disk or other types of computer readable media which can store data that are accessible by a computer, such as magnetic cassettes, flash memory cards, solid state memory devices, digital versatile disks, cartridges, random access memories (RAMs) 1025, read only memory (ROM) 1020, and hybrids thereof. The storage device 1030 can include services 1032, 1034, 1036 for controlling the processor 1010. Other hardware or software modules are contemplated. The storage device 1030 can be connected to the computing device connection 1005. In one aspect, a hardware module that performs a particular function can include the software component stored in a computer-readable medium in connection with the necessary hardware components, such as the processor 1010, connection 1005, output device 1035, and so forth, to carry out the function.

As understood by those of skill in the art, machine-learning based classification techniques can vary depending on the desired implementation. For example, machine-learning classification schemes can utilize one or more of the following, alone or in combination: hidden Markov models; recurrent neural networks; convolutional neural networks (CNNs); deep learning; Bayesian symbolic methods; general adversarial networks (GANs); support vector machines; image registration methods; applicable rule-based system. Where regression algorithms are used, they may include including but are not limited to: a Stochastic Gradient Descent Regressor, and/or a Passive Aggressive Regressor, etc.

Machine learning classification models can also be based on clustering algorithms (e.g., a Mini-batch K-means clustering algorithm), a recommendation algorithm (e.g., a Minimwise Hashing algorithm, or Euclidean Locality-Sensitive Hashing (LSH) algorithm), and/or an anomaly detection algorithm, such as a Local outlier factor. Additionally, machine-learning models can employ a dimensionality reduction approach, such as, one or more of: a Mini-batch Dictionary Learning algorithm, an Incremental Principal Component Analysis (PCA) algorithm, a Latent Dirichlet Allocation algorithm, and/or a Mini-batch K-means algorithm, etc.

For clarity of explanation, in some instances the present technology may be presented as including individual functional blocks including functional blocks comprising devices, device components, steps or routines in a method embodied in software, or combinations of hardware and software.

In some embodiments the computer-readable storage devices, mediums, and memories can include a cable or wireless signal containing a bit stream and the like. However, when mentioned, non-transitory computer-readable storage media expressly exclude media such as energy, carrier signals, electromagnetic waves, and signals per se.

Methods according to the above-described examples can be implemented using computer-executable instructions that are stored or otherwise available from computer readable media. Such instructions can include, for example, instructions and data, which cause or otherwise configure a general purpose computer, special purpose computer, or a processing device to perform a certain function or group of functions. Portions of computer resources used can be accessible over a network. The computer executable instructions may be, for example, binaries, intermediate format instructions such as assembly language, firmware, source code, etc. Examples of computer-readable media that may be used to store instructions, information used, and/or information created during methods according to described examples include magnetic or optical disks, flash memory, USB devices provided with non-volatile memory, networked storage devices, and so on.

Devices implementing methods according to these disclosures can include hardware, firmware and/or software, and can take any of a variety of form factors. Typical examples of such form factors include laptops, smart phones, small form factor personal computers, personal digital assistants, rackmount devices, standalone devices, and so on. Functionality described herein also can be embodied in peripherals or add-in cards. Such functionality can also be implemented on a circuit board among different chips or different processes executing in a single device, by way of further example.

The instructions, media for conveying such instructions, computing resources for executing them, and other structures for supporting such computing resources are example means for providing the functions described in the disclosure.

In the foregoing description, aspects of the application are described with reference to specific embodiments thereof, but those skilled in the art will recognize that the application is not limited thereto. Thus, while illustrative embodiments of the application have been described in detail herein, it is to be understood that the disclosed concepts may be otherwise variously embodied and employed, and that the appended claims are intended to be construed to include such variations, except as limited by the prior art. Various features and aspects of the above-described subject matter may be used individually or jointly. Further, embodiments can be utilized in any number of environments and applications beyond those described herein without departing from the broader spirit and scope of the specification. The specification and drawings are, accordingly, to be regarded as illustrative rather than restrictive. For the purposes of illustration, methods were described in a particular order. It should be appreciated that in alternate embodiments, the methods may be performed in a different order than that described.

Where components are described as being "configured to" perform certain operations, such configuration can be accomplished, for example, by designing electronic circuits or other hardware to perform the operation, by programming programmable electronic circuits (e.g., microprocessors, or other suitable electronic circuits) to perform the operation, or any combination thereof.

The various illustrative logical blocks, modules, circuits, and algorithm steps described in connection with the examples disclosed herein may be implemented as electronic hardware, computer software, firmware, or combinations thereof. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present application.

The techniques described herein may also be implemented in electronic hardware, computer software, firmware, or any combination thereof. Such techniques may be implemented in any of a variety of devices such as general purposes computers, wireless communication device handsets, or integrated circuit devices having multiple uses including application in wireless communication device handsets and other devices. Any features described as modules or components may be implemented together in an integrated logic device or separately as discrete but interoperable logic devices. If implemented in software, the techniques may be realized at least in part by a computer-readable data storage medium comprising program code including instructions that, when executed, performs one or more of the method, algorithms, and/or operations described above. The computer-readable data storage medium may form part of a computer program product, which may include packaging materials.

The computer-readable medium may include memory or data storage media, such as random access memory (RAM) such as synchronous dynamic random access memory (SDRAM), read-only memory (ROM), non-volatile random access memory (NVRAM), electrically erasable programmable read-only memory (EEPROM), FLASH memory, magnetic or optical data storage media, and the like. The techniques additionally, or alternatively, may be realized at least in part by a computer-readable communication medium that carries or communicates program code in the form of instructions or data structures and that can be accessed, read, and/or executed by a computer, such as propagated signals or waves.

Other embodiments of the disclosure may be practiced in network computing environments with many types of computer system configurations, including personal computers, hand-held devices, multi-processor systems, microprocessor-based or programmable consumer electronics, network PCs, minicomputers, mainframe computers, and the like. Embodiments may also be practiced in distributed computing environments where tasks are performed by local and remote processing devices that are linked (either by hardwired links, wireless links, or by a combination thereof) through a communications network. In a distributed computing environment, program modules may be located in both local and remote memory storage devices.

In the above description, terms such as "upper," "upward," "lower," "downward," "above," "below," "downhole," "uphole," "longitudinal," "lateral," and the like, as used herein, shall mean in relation to the bottom or furthest extent of the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Additionally, the illustrate embodiments are illustrated such that the orientation is such that the right-hand side is downhole compared to the left-hand side.

The term "coupled" is defined as connected, whether directly or indirectly through intervening components, and is not necessarily limited to physical connections. The connection can be such that the objects are permanently connected or releasably connected. The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or another word that substantially modifies, such that the component need not be exact. For example, substantially cylindrical means that the object resembles a cylinder, but can have one or more deviations from a true cylinder.

The term "radially" means substantially in a direction along a radius of the object, or having a directional component in a direction along a radius of the object, even if the object is not exactly circular or cylindrical. The term "axially" means substantially along a direction of the axis of the object. If not specified, the term axially is such that it refers to the longer axis of the object.

Although a variety of information was used to explain aspects within the scope of the appended claims, no limitation of the claims should be implied based on particular features or arrangements, as one of ordinary skill would be able to derive a wide variety of implementations. Further and although some subject matter may have been described in language specific to structural features and/or method steps, it is to be understood that the subject matter defined in the appended claims is not necessarily limited to these described features or acts. Such functionality can be distributed differently or performed in components other than those identified herein. The described features and steps are disclosed as possible components of systems and methods within the scope of the appended claims.

Moreover, claim language reciting "at least one of" a set indicates that one member of the set or multiple members of the set satisfy the claim. For example, claim language reciting "at least one of A and B" means A, B, or A and B.

Statements of the disclosure include:

Statement 1: A computer-implemented method for optimizing multi-unit pumping operations at a well site, the computer-implemented method comprising: receiving sensor data from a hydraulic fracturing fleet equipment at an equipment system; designating an event as being flagged based on the sensor data from the hydraulic fracturing fleet equipment; determining a physical action based on the flagged event and a priority list of actions; and providing instructions to a first pump of the hydraulic fracturing fleet equipment to perform the physical action based on the flagged event and the priority list of actions.

Statement 2: The computer-implemented method of Statement 1, wherein the designating of the event as being flagged indicates that the event has breached an optimum range of operation.

Statement 3: The computer-implemented method of any of Statements 1 to 2, wherein the physical action indicates an adjustment of a parameter of at least one of the hydraulic fracturing fleet equipment.

Statement 4: The computer-implemented method of any of Statements 1 to 3, further comprising updating the priority list of actions based on receiving new instructions that rearrange, augment, or reduce the priority list of actions.

Statement 5: The computer-implemented method of any of Statements 1 to 4, further comprising: receiving a first asynchronous message including a first unique asynchronous message identifier from the first pump of the hydraulic fracturing fleet equipment; and providing a synchronous message including a unique synchronous message identifier to at least one actuator based on the first asynchronous message including the first unique asynchronous message identifier.

Statement 6: The computer-implemented method of any of Statements 1 to 5, further comprising receiving a second asynchronous message including a second unique asynchronous message identifier from a second pump of the hydraulic fracturing fleet equipment.

Statement 7: The computer-implemented method of any of Statements 1 to 6, wherein the first unique asynchronous message identifier of the first asynchronous message is different from the second unique asynchronous message identifier of the second asynchronous message.

Statement 8: A system for optimizing multi-unit pumping operations at a well site, the system comprising: one or more processors; and at least one computer-readable storage medium having stored therein instructions which, when executed by the one or more processors, cause the system to: receive sensor data from a hydraulic fracturing fleet equipment at an equipment system; designate an event as being flagged based on the sensor data from the hydraulic fracturing fleet equipment; determine a physical action based on the flagged event and a priority list of actions; and provide instructions to a first pump of the hydraulic fracturing fleet equipment to perform the physical action based on the flagged event and the priority list of actions.

Statement 9: The system of Statement 8, wherein the designation of the event as being flagged indicates that the event has breached an optimum range of operation.

Statement 10: The system of any of Statements 8 to 9, wherein the physical action indicates an adjustment of a parameter of at least one of the hydraulic fracturing fleet equipment.

Statement 11: The system of any of Statements 8 to 10, wherein the instructions, when executed by the one or more processors, further cause the system to update the priority list of actions based on receiving new instructions that rearrange, augment, or reduce the priority list of actions.

Statement 12: The system of any of Statements 8 to 11, wherein the instructions, when executed by the one or more processors, further cause the system to: receive a first asynchronous message including a first unique asynchronous message identifier from the first pump of the hydraulic fracturing fleet equipment; and provide a synchronous message including a unique synchronous message identifier to at least one actuator based on the first asynchronous message including the first unique asynchronous message identifier.

Statement 13: The system of any of Statements 8 to 12, wherein the instructions, when executed by the one or more processors, further cause the system to receive a second asynchronous message including a second unique asynchronous message identifier from a second pump of the hydraulic fracturing fleet equipment.

Statement 14: The system of any of Statements 8 to 13, wherein the first unique asynchronous message identifier of the first asynchronous message is different from the second unique asynchronous message identifier of the second asynchronous message.

Statement 15: A non-transitory computer-readable storage medium comprising: instructions stored on the non-transitory computer-readable storage medium, the instructions, when executed by one or more processors, cause the one or more processors to: receive sensor data from a hydraulic fracturing fleet equipment at an equipment system; designate an event as being flagged based on the sensor data from the hydraulic fracturing fleet equipment; determine a physical action based on the flagged event and a priority list of actions; and provide instructions to a first pump of the hydraulic fracturing fleet equipment to perform the physical action based on the flagged event and the priority list of actions.

Statement 16: The non-transitory computer-readable storage medium of Statement 15, wherein the designation of the event as being flagged indicates that the event has breached an optimum range of operation.

Statement 17: The non-transitory computer-readable storage medium of any of Statements 15 to 16, wherein the physical action indicates an adjustment of a parameter of at least one of the hydraulic fracturing fleet equipment.

Statement 18: The non-transitory computer-readable storage medium of any of Statements 15 to 17, wherein the instructions, when executed by the one or more processors, further cause the one or more processors to update the priority list of actions based on receiving new instructions that rearrange, augment, or reduce the priority list of actions.

Statement 19: The non-transitory computer-readable storage medium of any of Statements 15 to 18, receive a first asynchronous message including a first unique asynchronous message identifier from the first pump of the hydraulic fracturing fleet equipment; and provide a synchronous message including a unique synchronous message identifier to at least one actuator based on the first asynchronous message including the first unique asynchronous message identifier.

Statement 20: The non-transitory computer-readable storage medium of any of Statements 15 to 19, wherein the instructions, when executed by the one or more processors, further cause the one or more processors to receive a second asynchronous message including a second unique asynchronous message identifier from a second pump of the hydraulic fracturing fleet equipment, the first unique asynchronous message identifier of the first asynchronous message being different from the second unique asynchronous message identifier of the second asynchronous message.

What is claimed is:

1. A computer-implemented method for optimizing multi-unit pumping operations at a well site, the computer-implemented method comprising:

receiving sensor data from hydraulic fracturing fleet equipment at an equipment system;

designating an event as being flagged based on the sensor data from the hydraulic fracturing fleet equipment, wherein the designation of the event as being flagged includes a rotation per minute of a pump, a volume of fluid in the pump, a temperature in the pump, a pressure in the pump, or a combination thereof;

determining a physical action based on the flagged event and a priority list of actions; and providing instructions to a first pump of the hydraulic fracturing fleet equipment to perform the physical action based on the flagged event and the priority list of actions.

2. The computer-implemented method of claim 1, wherein the designating of the event as being flagged indicates that the event has breached an optimum range of operation.

3. The computer-implemented method of claim 1, wherein the physical action indicates an adjustment of a parameter of at least one of the hydraulic fracturing fleet equipment.

4. The computer-implemented method of claim 1, further comprising updating the priority list of actions based on receiving new instructions that rearrange, augment, or reduce the priority list of actions.

5. The computer-implemented method of claim 1, further comprising:

receiving a first asynchronous message including a first unique asynchronous message identifier from the first pump of the hydraulic fracturing fleet equipment; and providing a synchronous message including a unique synchronous message identifier to at least one actuator based on the first asynchronous message including the first unique asynchronous message identifier.

6. The computer-implemented method of claim 5, further comprising receiving a second asynchronous message including a second unique asynchronous message identifier from a second pump of the hydraulic fracturing fleet equipment.

7. The computer-implemented method of claim 6, wherein the first unique asynchronous message identifier of the first asynchronous message is different from the second unique asynchronous message identifier of the second asynchronous message.

8. A system for optimizing multi-unit pumping operations at a well site, the system comprising:

one or more processors; and at least one computer-readable storage medium having stored therein instructions which, when executed by the one or more processors, cause the system to:

receive sensor data from a hydraulic fracturing fleet equipment at an equipment system;

designate an event as being flagged based on the sensor data from the hydraulic fracturing fleet equipment, wherein the designation of the event as being flagged includes a rotation per minute of a pump, a volume of fluid in the pump, a temperature in the pump, a pressure in the pump, or a combination thereof;

determine a physical action based on the flagged event and a priority list of actions; and provide instructions to a first pump of the hydraulic fracturing fleet equipment to perform the physical action based on the flagged event and the priority list of actions.

9. The system of claim 8, wherein the designation of the event as being flagged indicates that the event has breached an optimum range of operation.

10. The system of claim 8, wherein the physical action indicates an adjustment of a parameter of at least one of the hydraulic fracturing fleet equipment.

11. The system of claim 8, wherein the instructions, when executed by the one or more processors, further cause the system to update the priority list of actions based on receiving new instructions that rearrange, augment, or reduce the priority list of actions.

12. The system of claim 8, wherein the instructions, when executed by the one or more processors, further cause the system to:

receive a first asynchronous message including a first unique asynchronous message identifier from the first pump of the hydraulic fracturing fleet equipment; and provide a synchronous message including a unique synchronous message identifier to at least one actuator based on the first asynchronous message including the first unique asynchronous message identifier.

13. The system of claim 12, wherein the instructions, when executed by the one or more processors, further cause the system to receive a second asynchronous message including a second unique asynchronous message identifier from a second pump of the hydraulic fracturing fleet equipment.

14. The system of claim 13, wherein the first unique asynchronous message identifier of the first asynchronous message is different from the second unique asynchronous message identifier of the second asynchronous message.

15. A non-transitory computer-readable storage medium comprising:

instructions stored on the non-transitory computer-readable storage medium, the instructions, when executed by one or more processors, cause the one or more processors to:

receive sensor data from a hydraulic fracturing fleet equipment at an equipment system;

designate an event as being flagged based on the sensor data from the hydraulic fracturing fleet equipment, wherein the designation of the event as being flagged includes a rotation per minute of a pump, a volume of fluid in the pump, a temperature in the pump, a pressure in the pump, or a combination thereof;

determine a physical action based on the flagged event and a priority list of actions; and provide instructions to a first pump of the hydraulic fracturing fleet equipment to perform the physical action based on the flagged event and the priority list of actions.

16. The non-transitory computer-readable storage medium of claim 15, wherein the designation of the event as being flagged indicates that the event has breached an optimum range of operation.

17. The non-transitory computer-readable storage medium of claim 15, wherein the physical action indicates an adjustment of a parameter of at least one of the hydraulic fracturing fleet equipment.

18. The non-transitory computer-readable storage medium of claim 15, wherein the instructions, when executed by the one or more processors, further cause the one or more processors to update the priority list of actions based on receiving new instructions that rearrange, augment, or reduce the priority list of actions.

19. The non-transitory computer-readable storage medium of claim 15, wherein the instructions, when executed by the one or more processors, further cause the one or more processors to:

receive a first asynchronous message including a first unique asynchronous message identifier from the first pump of the hydraulic fracturing fleet equipment; and provide a synchronous message including a unique synchronous message identifier to at least one actuator based on the first asynchronous message including the first unique asynchronous message identifier.

20. The non-transitory computer-readable storage medium of claim 19, wherein the instructions, when executed by the one or more processors, further cause the one or more processors to receive a second asynchronous message including a second unique asynchronous message identifier from a second pump of the hydraulic fracturing fleet equipment, the first unique asynchronous message identifier of the first asynchronous message being different from the second unique asynchronous message identifier of the second asynchronous message.

* * * * *